United States Patent [19]

Kamikura et al.

[11] Patent Number: 4,480,931

[45] Date of Patent: Nov. 6, 1984

[54] ELECTRONIC TYPEWRITER

[75] Inventors: Shigeo Kamikura; Takeshi Itoh, both of Kodaira, Japan

[73] Assignee: Silver Seiko, Ltd., Tokyo, Japan

[21] Appl. No.: 356,382

[22] Filed: Mar. 9, 1982

[30] Foreign Application Priority Data

Mar. 16, 1981 [JP] Japan ..... 56-37494

[51] Int. Cl.[3] ..... B41J 5/30

[52] U.S. Cl. ..... 400/63; 400/697; 400/711

[58] Field of Search ..... 400/697, 697.1, 711, 400/83-85, 63

[56] References Cited

U.S. PATENT DOCUMENTS

| | | | |
|---|---|---|---|
| 3,631,957 | 1/1972 | Terry | 400/64 |
| 3,757,921 | 9/1973 | Bishop | 400/64 |
| 3,780,846 | 12/1973 | Kolpek et al. | 400/697 X |
| 4,017,848 | 4/1977 | Tannas | 340/365 VL X |
| 4,136,395 | 1/1979 | Kolpek et al. | 400/63 X |
| 4,265,554 | 5/1981 | Clancy et al. | 400/316 |
| 4,270,865 | 6/1981 | Konishi | 400/63 |
| 4,374,626 | 2/1983 | Hooker | 400/697.1 |

FOREIGN PATENT DOCUMENTS

| | | | |
|---|---|---|---|
| 2929560 | 2/1980 | Fed. Rep. of Germany . | |
| 54-152513 | 11/1979 | Japan . | |
| 2031626 | 4/1980 | United Kingdom | 400/697.1 |

*Primary Examiner*—Paul T. Sewell

*Attorney, Agent, or Firm*—Lane, Aitken & Kananen

[57] ABSTRACT

An electronic typewriter which provides for significant simplification of machine operations. The typewriter includes automatic error correcting function associated with electronic controls and a memory. A series of text data which have been deleted during an incessant error correcting operation are stored in a specially provided buffer memory from which they can be recalled upon depression of a print initiating key for causing the corresponding text to be printed automatically. An LED indicates that the current print line contains printed characters which can be erased by such automatic correcting operation. The typewriter further provides for simplified indentation and a novel carrier return mode.

8 Claims, 56 Drawing Figures

ELECTRONIC TYPEWRITER

BACKGROUND OF THE INVENTION

This invention relates to an electronic typewriter, and more particularly to an electronic typewriter with error correcting function, which is associated with electronic controls and a memory, and which permits the erasure or correction of characters by the mere depression of an error correction key.

While one is writing on a typewriter, it often becomes necessary to correct or erase errors in the previously printed text. In typewriters presently available which are provided with an error correcting function, when an error correction key is depressed, a memory is read to determine which character was previously printed and the typewriter automatically makes a correction of that character if possible. Thus, errors can be easily corrected on such machines. In some cases, it may be necessary or desirable to insert a character or characters, a word, a sentence, a phrase and so on, into the already printed text, or to rearrange some words or phrases to a different position. Such presently available electronic typewriters do not sufficiently conveniently cope with these situations: first, at least part of the print line which is to be subject to modification such as insertion of a word and a succeeding print line or lines, if any, must possibly be erased by repetitive or continued depression of the erasure or correct key and/or a repeating function key known as a repeat key, and then, after, for example, a word is printed at a position to be inserted through the keyboard input, the keyboard must be operated to print the erased text again at a different location.

It is an object of the present invention to provide an electronic typewriter with an automatic error correction function in which the text which has been erased or corrected by automatic correction can be printed anywhere again upon depression of a key provided for initiation of such printing.

SUMMARY OF THE INVENTION

According to one aspect of this invention, there is provided a typewriter having a platen, a printing mechanism for printing characters on a record sheet supported on said platen, a print buffer for storing therein character data being printed on the record sheet, and an automatic correction mechanism for addressing said print buffer and for deleting printed characters on the record sheet, comprising: storage memory means for storing therein coded data representative of characters being deleted by said correction mechanism; a manually operable print enabling key; and addressing means responsive to said key for successively addressing said storage memory to recall the character data stored therein and for causing said printing mechanism to print on the record sheet a character or characters in accordance with the character data thus recalled.

Preferably, the typewriter further comprises a no-print key for preventing printing operation of said printing mechanism while allowing character data to be stored in said print buffer, a first operation of said print enabling key after preceding depression of said no-print key invalidating the effect of said no-print key whereas a second operation of said print enabling key may render said addressing means operative.

The typewriter may also comprise a no-print key for preventing a deleting operation of said correction mechanism, while allowing said print buffer to be addressed by said correction mechanism and allowing coded character data to be stored in said storage memory means, a first operation of said print enabling key after a preceding depression of said no-print key invalidating the effect of said no-print key whereas a second operation of said print enabling key will render said addressing means operative.

According to another aspect of this invention, there is provided a typewriter having a platen, a printing mechanism for printing characters on a record sheet supported on said platen, bidirectional feeding means for feeding said printing mechanism relative to said platen, a bidirectional line indexing mechanism, a print buffer for storing therein character data being printed on the record sheet, said print buffer being capable of storing therein a predetermined number of lines of characters last printed, and an automatic correction mechanism for addressing said print buffer and for deleting printed characters from the record sheet, comprising: a line position register responsive to operation of said line indexing mechanism for storing a count indicative of a current print line position; a plurality of line index registers each for storing a count indicative of a print line position corresponding to a print line which includes at least one character printed; indicator means for indicating the presence of characters printed in and hence automatically deletable from the current print line on the record sheet; and means responsive to operation of said line indexing mechanism for successively comparing the contents of said line index registers with the contents of said line position register and for activating said indicator means if a coincidence is reached.

Preferably, the printing point defined by and between said platen and said printing mechanism is backspaced within the current print line each time a printed character or a space is deleted.

The typewriter may further comprise a plurality of line format registers each corresponding to one of said line index registers for storing data representative of the first and end print positions for a given print line, activation of said correction mechanism when the current print point is at the first print position for a print line resulting in indexing of said platen to the preceding print line if available and then feeding of said printing mechanism to the end print position for the thus indexed print line thereby to enable subsequent succeeding automatic deletion of printed characters for the print line by said correction mechanism.

The typewriter may also further comprise: storage memory means for storing therein coded data representative of characters being deleted by said correction mechanism; a manually operable print enabling key; and addressing means responsive to said key for successively addressing said storage memory to recall the character data stored therein and for causing said printing mechanism to print on the record sheet a character or characters in accordance with the character data thus recalled.

Additionally, the typewriter may further comprise a no-print key for preventing printing operation of said printing mechanism while allowing character data to be stored in said print buffer, a first operation of said print enabling key after a preceding depression of said no-print key invalidating the effect of said no-print key whereas a second operation of said print enabling key will render said addressing means operative.

Also, the typewriter may further comprise a no-print key for preventing a deleting operation of said correction mechanism while allowing said print buffer to be addressed by said correction mechanism and the coded character data to be stored in said storage memory means, a first operation of said print enabling key after a preceding depression of said no-print key invalidating the effect of said no-print key whereas a second operation of said print enabling key will render said addressing means operative.

Preferably, the typewriter further comprises an error correction key manually operable to activate said automatic correction mechanism, said indicator means including a light emitting element which is associated with said correction key.

According to yet another aspect of the invention, there is provided a typewriter having a platen, a printing mechanism for printing characters on a record sheet supported on said platen, feeding means for moving said printing mechanism relative to said platen to define successive print points, means for setting a left margin, and a left margin register for storing therein a count indicative the left margin thus set to which said printing mechanism is to return by carrier return operation, comprising: tab stock means for storing therein counts each indicative of a tab point; means for providing a tabulating instruction; tabulating means responsive to a tabulating instruction for searching said tab stock means for a following next tab point and for causing said printing mechanism to be moved to the following next tab point; and a key independent of the providing means and manually operable to provide a tabulating instruction to said tabulating means and to cause a count indicative of the following next tab point to be stored in said left margin register.

The typewriter may further comprise a left margin save register for storing the count of the left margin set by the margin setting means so as to enable, upon a second operation of said key, the thus set left margin count to be stored in said left margin register again, and may further comprise indicator means for indicating that said printing mechanism is to return to a point other than the left margin set by the margin setting means. Preferably, said indicator means includes a light emitting element which is associated with said key.

According to a further aspect of the invention, there is provided a typewriter having a platen, a printing mechanism for printing characters on a record sheet supported on said platen, feeding means for moving said printing mechanism relative to said platen to define successive print positions, a right margin register for storing therein a count indicative of a prescribed right margin for a print line, a left margin register for storing therein a count indicative of a left margin for the print line, and a margin release key, comprising: selector means having first and second positions; and control means responsive to said selector means in the second position for invalidating said right margin thereby to enable said printing mechanism to print characters successively beyond the right margin position.

The typewriter may further comprise a control zone register for storing therein a count representative of the leftward extreme end of a control zone, said control means being responsive to a first spacing or hyphenation instruction during printing at a position at or rightwardly of the position represented by the leftward extreme end of said control zone for activating said feeding means to automatically return said printing mechanism to the left margin print position.

One way of carrying out the invention is described in detail below with reference to the drawings which illustrate, by way of example, one embodiment of the invention, and in which:

BRIEF DESCRIPTION OF THE DRAWINGS

FIGS. 9 to 29 are flow charts showing subroutines of the program, of which FIGS. 9(*a*) to (*e*) are for a character printing operation, FIGS. 10(*a*) to 10(*d*) are for a spacing operation, FIGS. 11(*a*) to (*e*) are for a backspacing operation, FIGS. 12(*a*) to 12(*e*) are for an automatic correcting operation, FIGS. 13(*a*) to 13(*e*) are for a tabulating operation, FIG. 14 is for a next tab stop searching operation, FIGS. 15(*a*) and 15(*b*) are for an indenting operation, FIG. 16 is for a carrier relocating operation, FIG. 17 is for a foward paper feeding operation, FIG. 18 is for a reverse paper feeding operation, FIGS. 19(*a*) and 19(*b*) are for a carrier location indexing operation, FIG. 20 is for a shifting operation, FIG. 21 is for a manual correcting operation, FIG. 22 is for a control zone setting operation, FIG. 23 is for a carrier return operation, FIG. 24 is for a margin release operation, FIG. 25 is for a no-print operation, FIGS. 26(*a*) and 26(*b*) are for a printing operation, FIG. 27 is for an express return operation, FIG. 28 is for a buffer closing operation, and FIGS. 29(*a*) to 29(*c*) are for a buffer opening operation;

DETAILED DESCRIPTION OF THE PREFERRED EMBODIMENT

Figure 1:
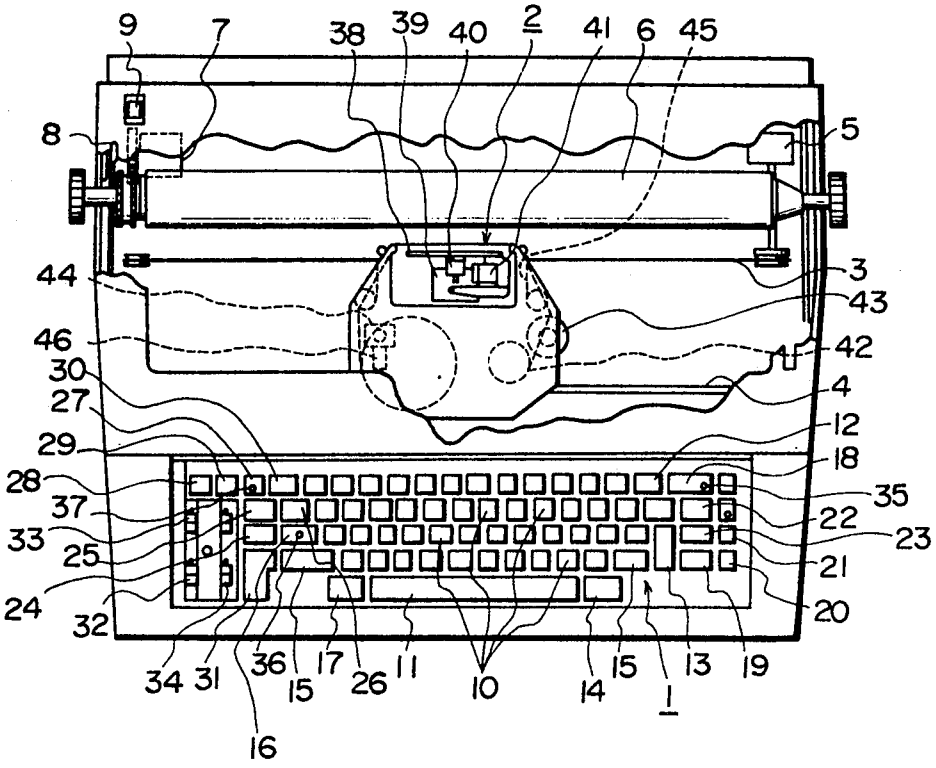
FIG. 1 is a top plan view, partly broken, of a typewriter embodying the present invention.

Referring first to FIG. 1, a typewriter embodying the present invention is illustrated as a daisy wheel typewriter which includes a type carrier 38 conventionally known as a daisy wheel. The typewriter includes a keyboard 1, a carrier 2 carrying the daisy wheel 38 and mounted for movement on a laterally extending rail 4 across the machine, a spacing motor 5 which may be a stepping motor linked to the carrier 2 through a wire 3 for providing bidirectional lateral stepwise movement of the carrier 2, a platen 6, a line feed motor 7 for stepwise rotating the platen 6 alternatively in a forward or reverse direction, a paper inserter switch 8 manually operable for activating the motor 7 to load a paper sheet in position on the platen 6, and a power switch 9 for turning on and off the power supply.

Figure 2:
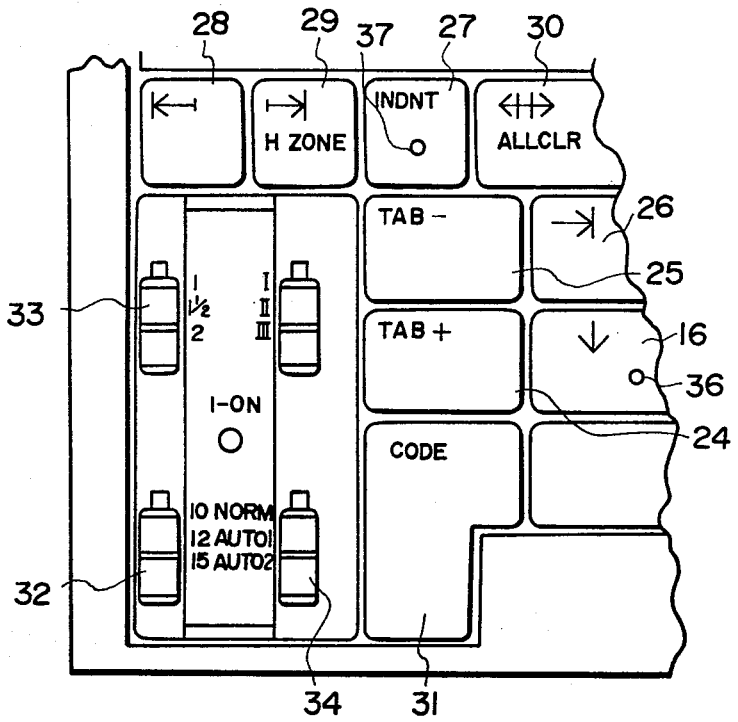
FIG. 2 is an enlarged top plan view of part of a keyboard of the typewriter of FIG. 1.

Referring to FIGS. 1 and 2, the keyboard 1 includes such keys as are provided on a conventional electric typewriter, such as a multiplicity of character keys 10, a space bar 11, a backspace key 12, a carrier return/line feed key 13, a pair of case shift keys 15, a shift lock key 16, a correction key 18, a line feed key 20, a reverse line feed key 21, a tab set key 24, a tab clear key 25, a tab key 26, a left margin set key 28, a right margin set key 29, a margin release key 30, and so on. The keyboard 1 includes additional keys as are provided on a conventional electronic typewriter, such as an express return key 14 for quickly feeding the carrier 2 in the reverse or leftward direction, a repeat key 17 for repetition of the last operation of the typewriter, a relocate key 19 for moving the carrier 2 back to a print line end position, a no-print key 22 for prohibiting printing of characters while permitting spacing of the carrier 2, a print key 23 for clearing the no-print key 22 and for allowing automatic printing of a text deleted, an indent key 27, and a code key 31 for bringing some other key into a dual function role. Some of these additional keys are involved in the present invention and will be hereinafter described in detail. The keyboard 1 may include further additional keys such as a centering key, a half space key, and so on.

The keyboard 1 further includes a space selector 32 for adjusting the spacing pitch of the carrier 2 to, for example, three steps, a line feed selector 33 for adjusting the line feed pitch to, for example, three steps, and a mode selector 34 for selecting the mode of the carrier return operation among three modes: in a first or "NORM" mode, the carrier 2 is returned from any position to the left margin position only by depression of the carrier return/line feed key 13; in a second or "AUTO 1" mode, the carrier 2 can be returned from a position within a zone known as a "control" or "hot" zone automatically by depression of the space bar 11 or a "hyphen(-)" key; and in a third or "AUTO 2" mode, the "control" zone is apparently extended beyond the right margin to the rightmost limit position so that the carrier 2 can be returned from any position in such extended control zone by depression of the space bar 11 or the "hyphen" key, as hereinafter described in detail.

Of the various keys mentioned above, the correct key 12, shift lock key 16 and indent key 27 have respective light emitting diodes (LED) 35, 36 and 37 embedded therein, which are illuminated when their respective keys are in effective or depressed condition. Hereafter, the didode 35 will be referred to as a correct LED and the diode 37 as an indent LED.

The carrier 2 has mounted thereon a type select motor 39 which may be a stepping motor for rotating the type wheel 38 to position a selected type to a print position, a type hammer 40 for hammering a selected type arm of the wheel 38 to impact the selected type against a paper sheet on the platen 6, a hammer actuator 41 for operating the hammer 40, an ink ribbon feed actuator 43 for feeding an ink ribbon 43, an ink ribbon lift actuator 44 for lifting the ink ribbon 43 to a print position, and a correct ribbon actuator 46 for lifting a correct ribbon 45 to a print position. The correct ribbon 43 is fed upon lifting motion thereof by a suitable mechanism not shown.

Figure 3:
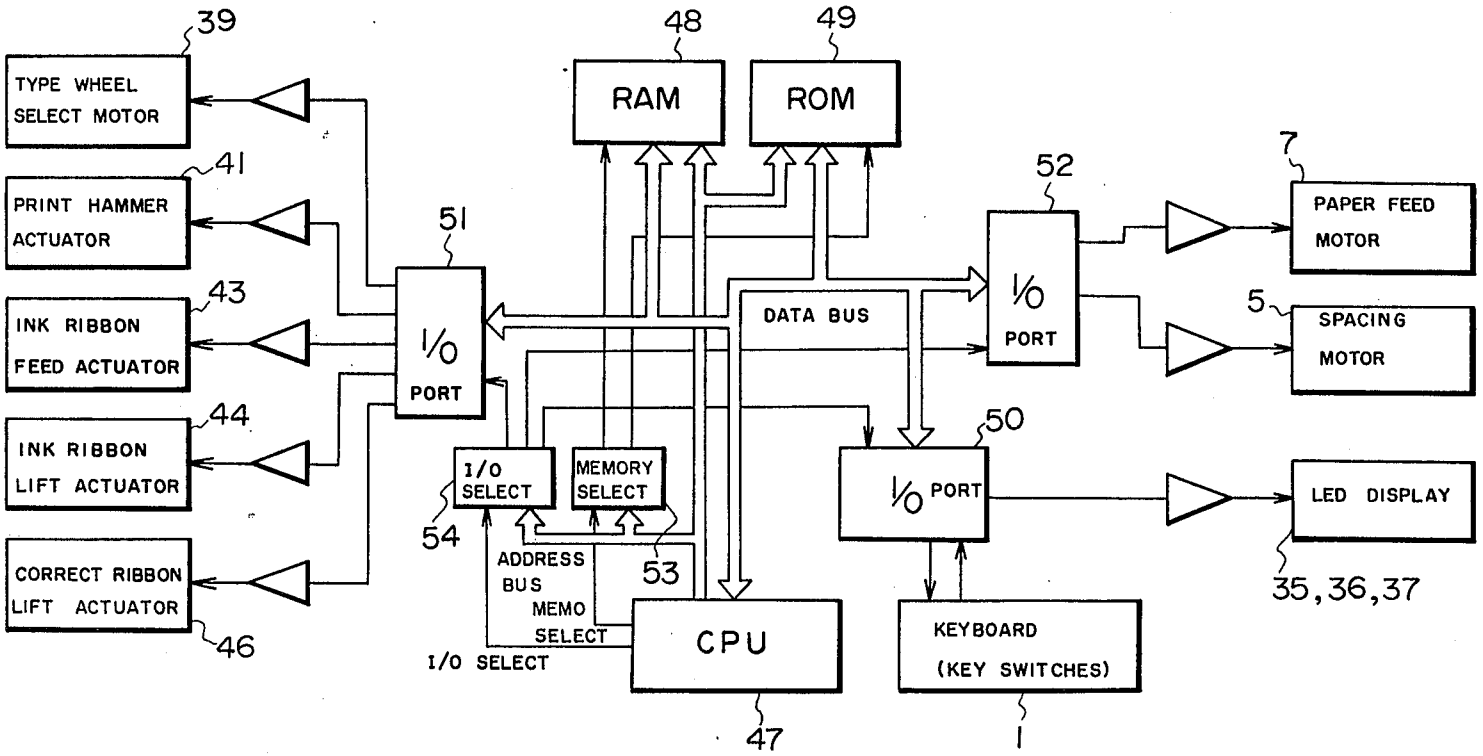
FIG. 3 is a schematic block diagram of the typewriter of FIG. 1.

The keyboard, more particularly, key switches mounted on the typewriter keyboard are electrically connected to a control apparatus including a microcomputer (microprocessor) as shown in FIG. 3 for electronically controlling the above-described motors, actuators and LED elements. More specifically, the control apparatus includes a CPU (central data processing unit) 47, memories including RAM (random access memory) 48 and ROM (read only memory) 49, input/output (I/O) ports 50 to 52, a memory selector decoder 53, and an I/O select decoder 54, which are totally arranged to electronically control the operations of the aforementioned motors, actuators and LED elements automatically in response to depression of any key on the keyboard 1.

Figure 8A:
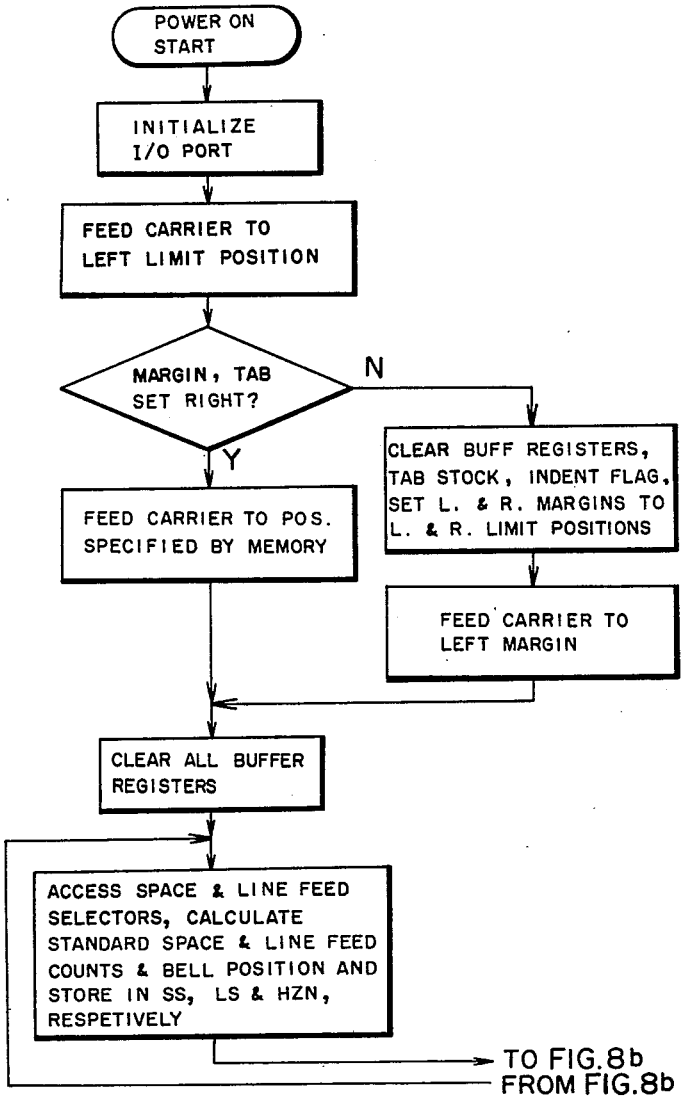
FIGS. 8(*a*) and 8(*b*) are a flow chart showing a main routine of a program for the typewriter.
Figure 8B:
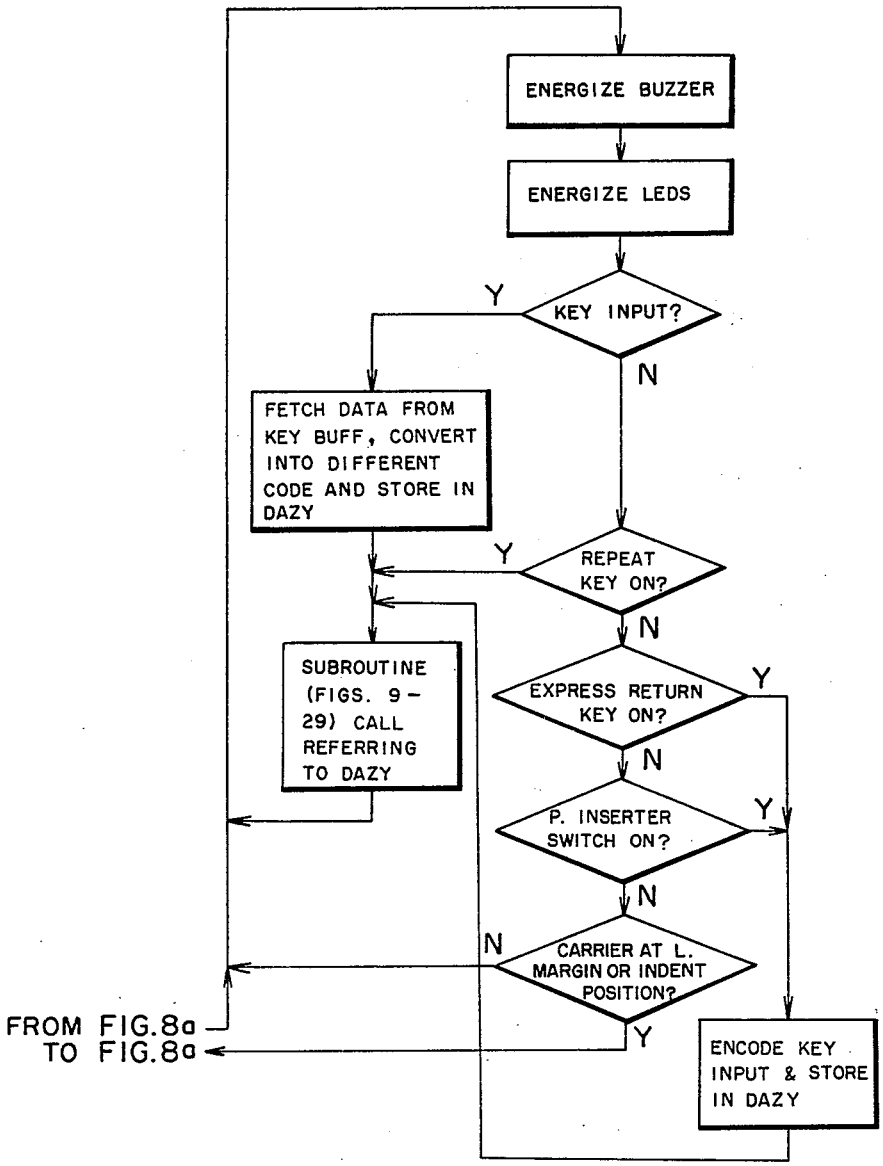
Figure 9A:
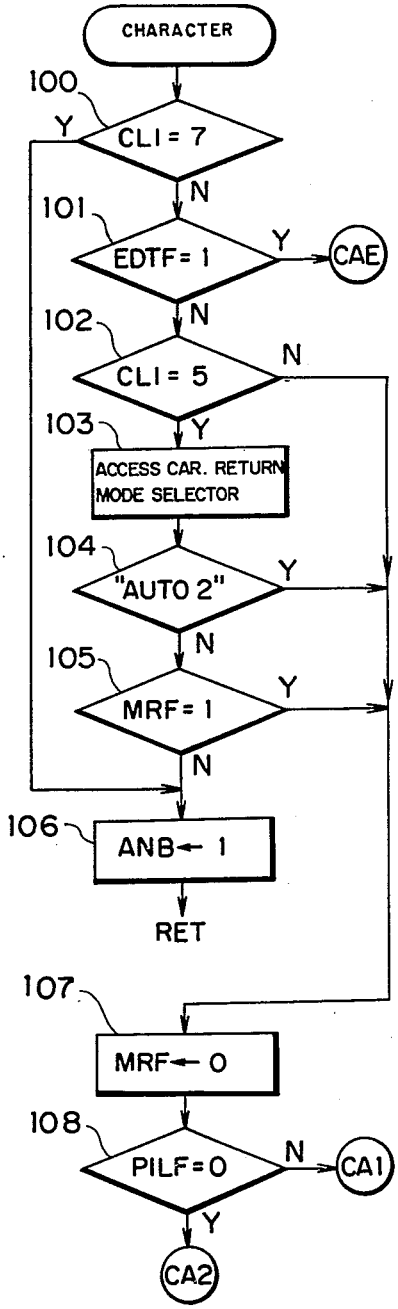
Figure 9B:
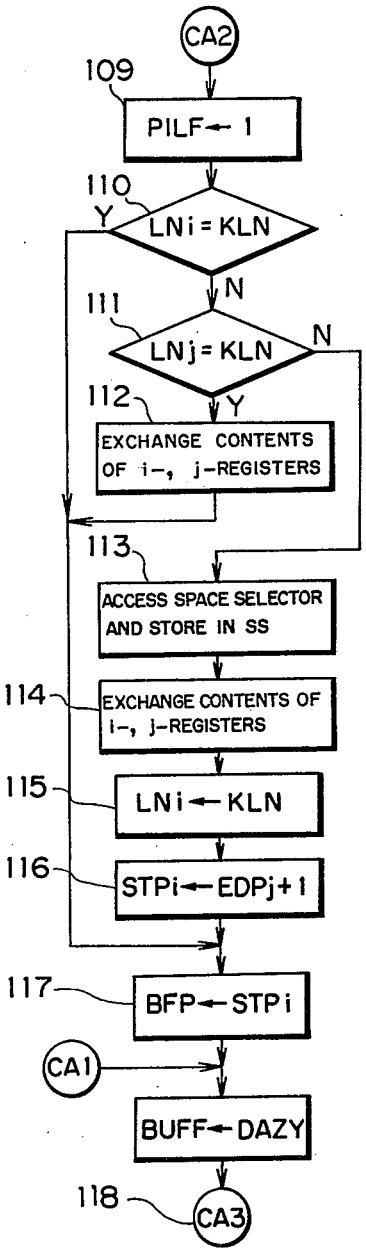
Figure 9C:
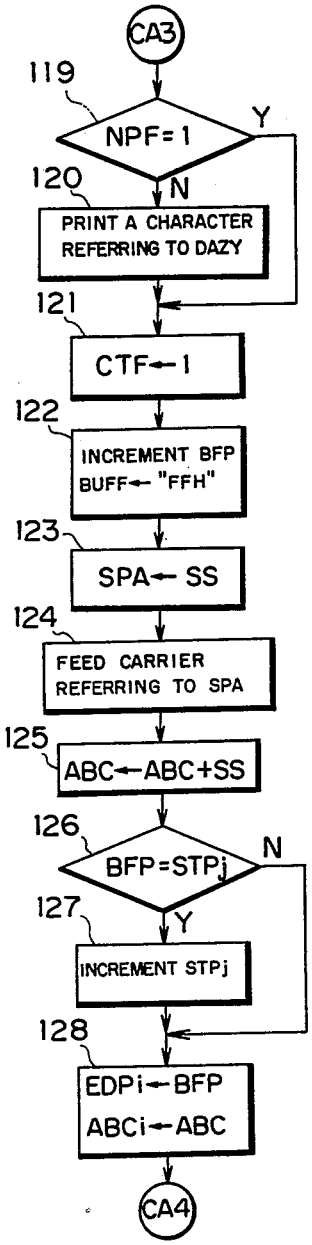
Figure 9D:
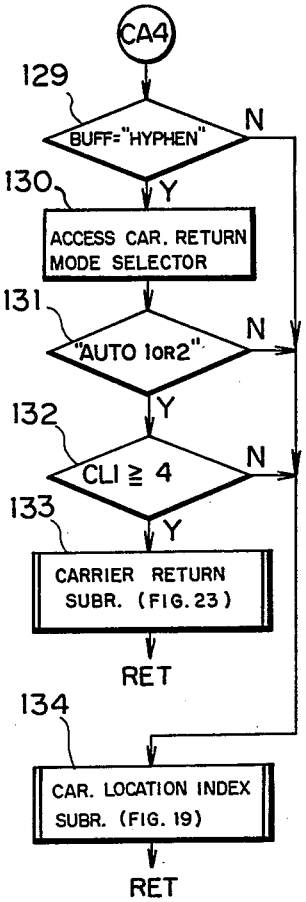
Figure 9E:
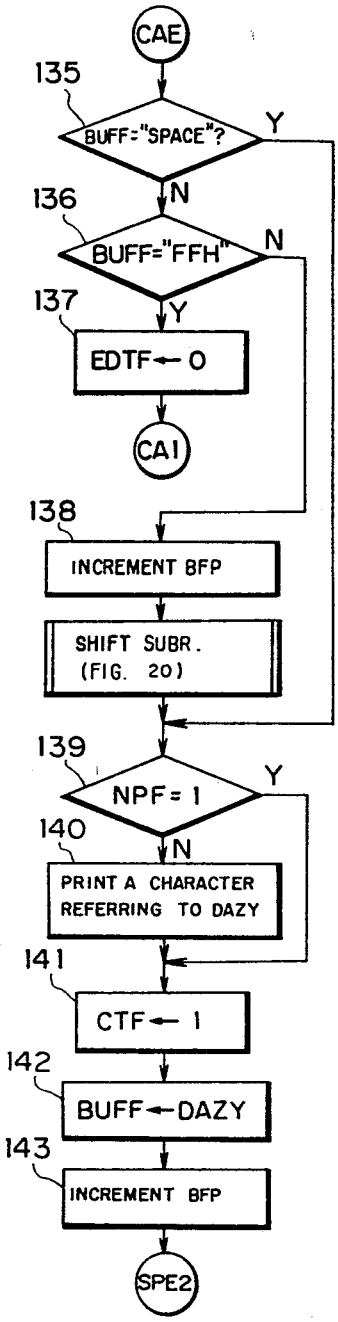
Figure 10A:
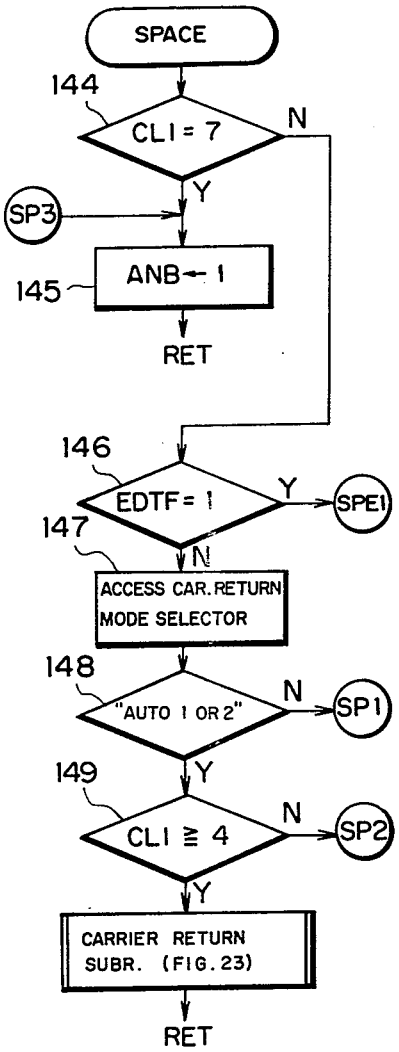
Figure 10B:
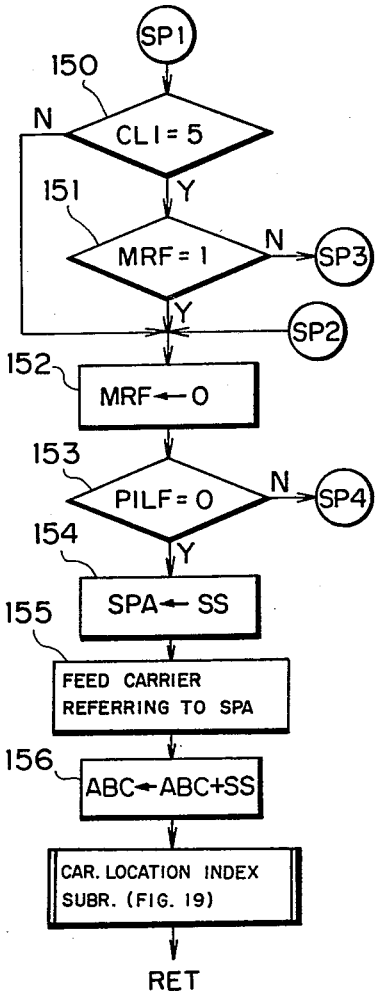
Figure 10C:
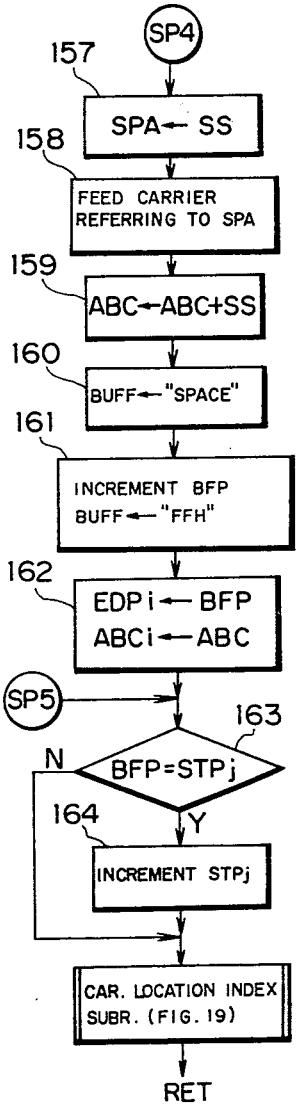
Figure 10D:
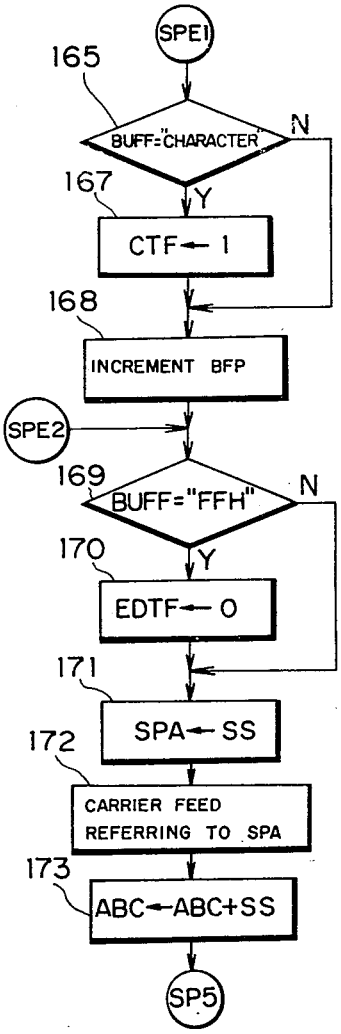
Figure 11A:
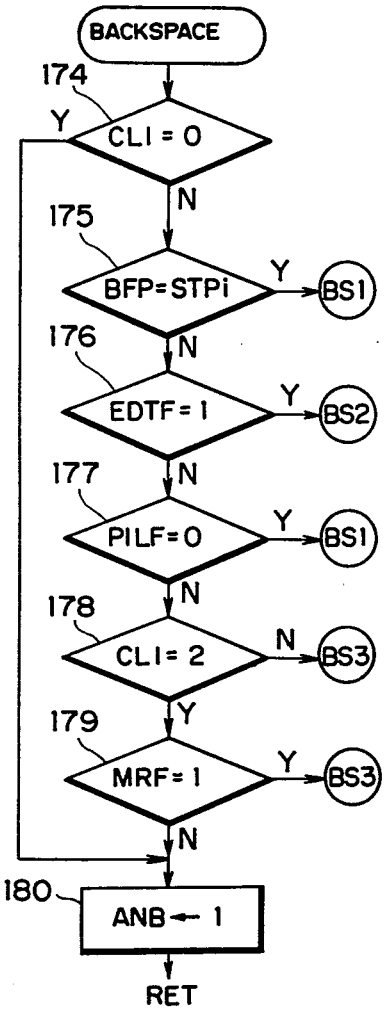
Figure 11B:
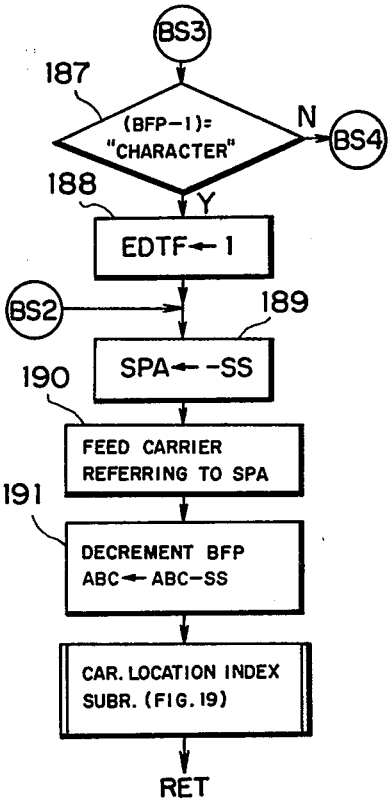
Figure 11C:
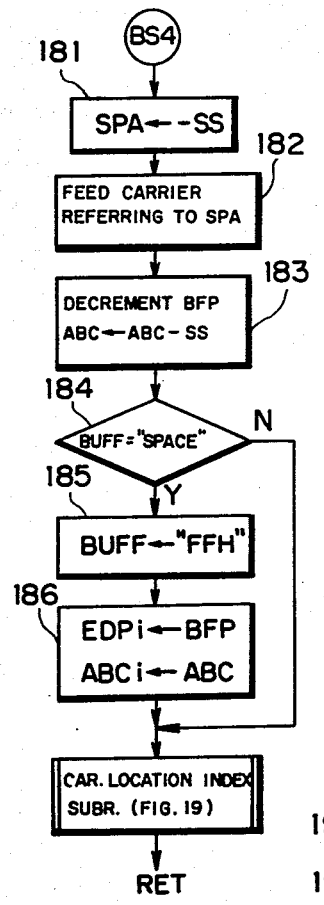
Figure 11D:
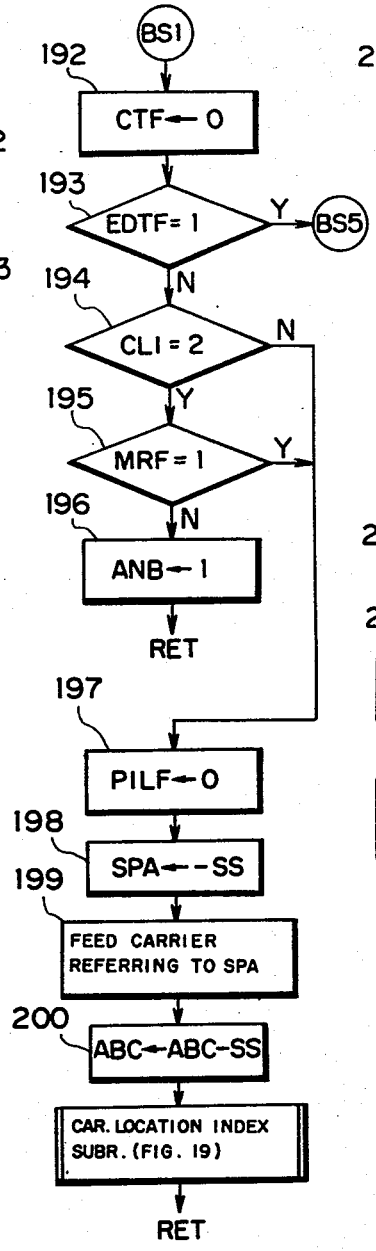
Figure 11E:
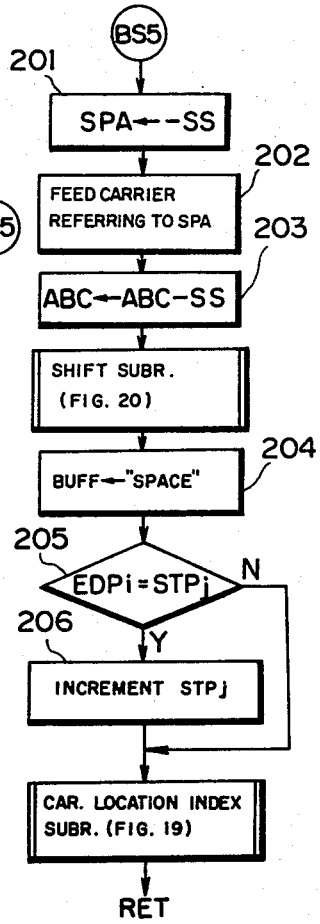
Figure 12A:
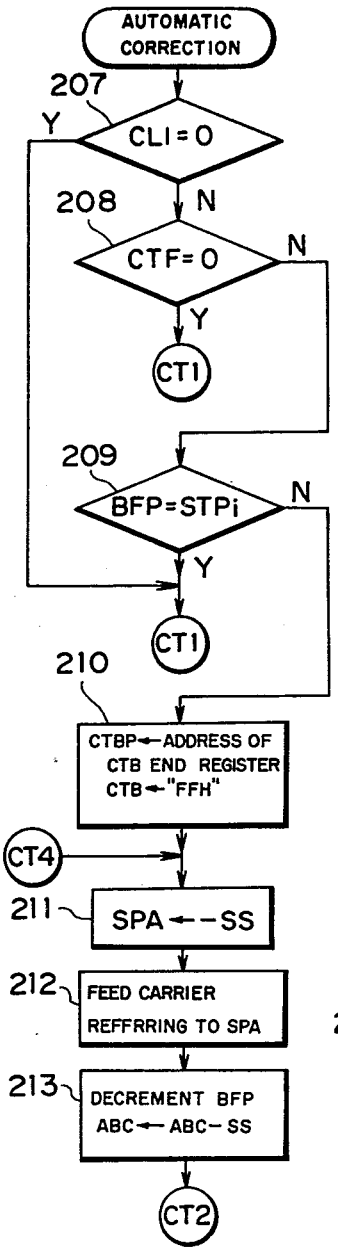
Figure 12B:
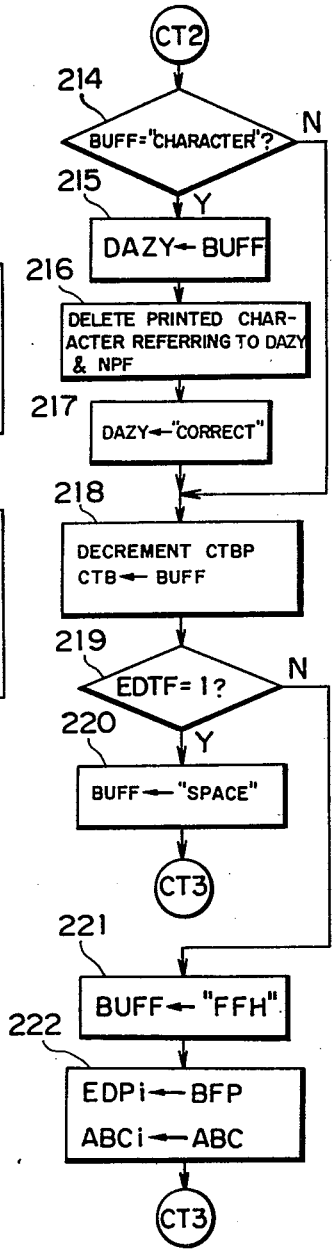
Figure 12C:
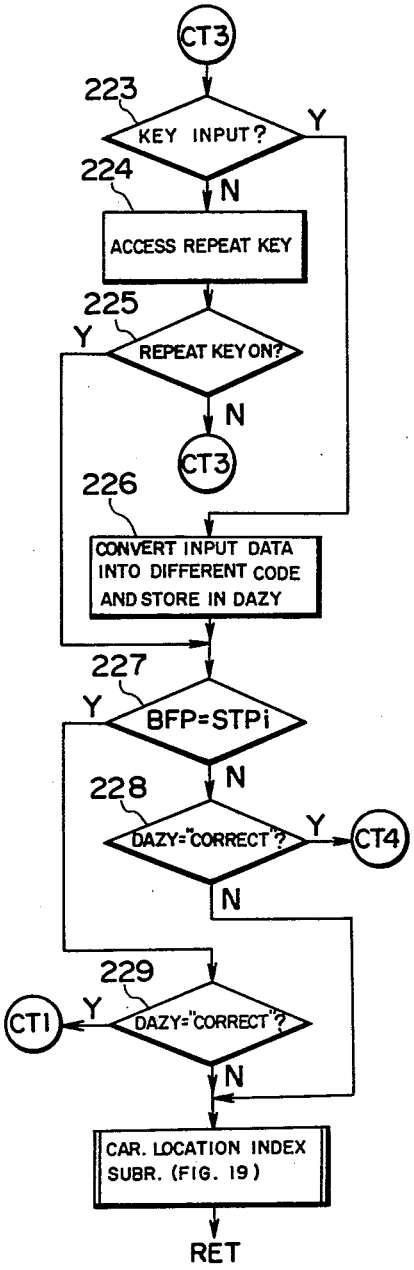
Figure 12D:
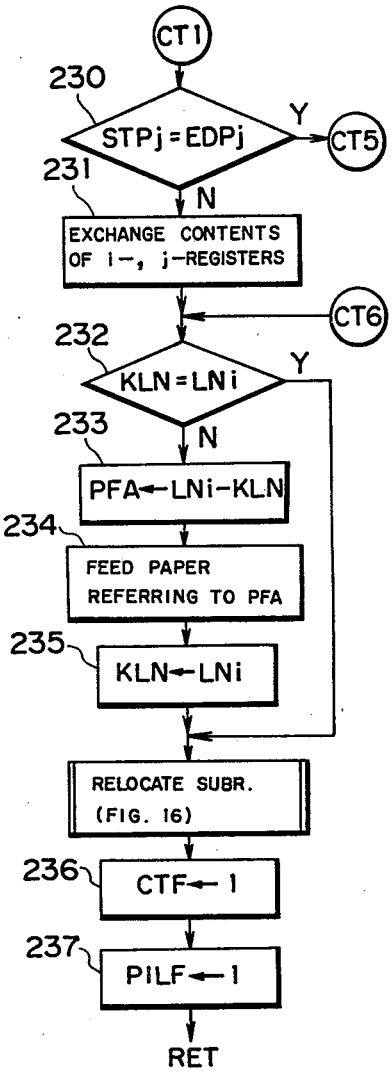
Figure 12E:
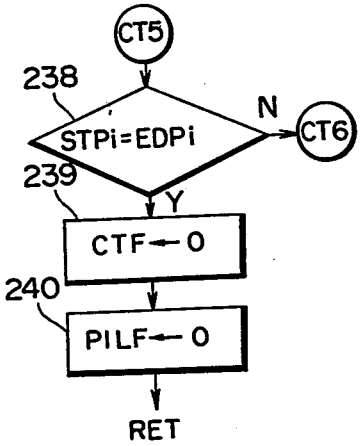
Figure 13A:
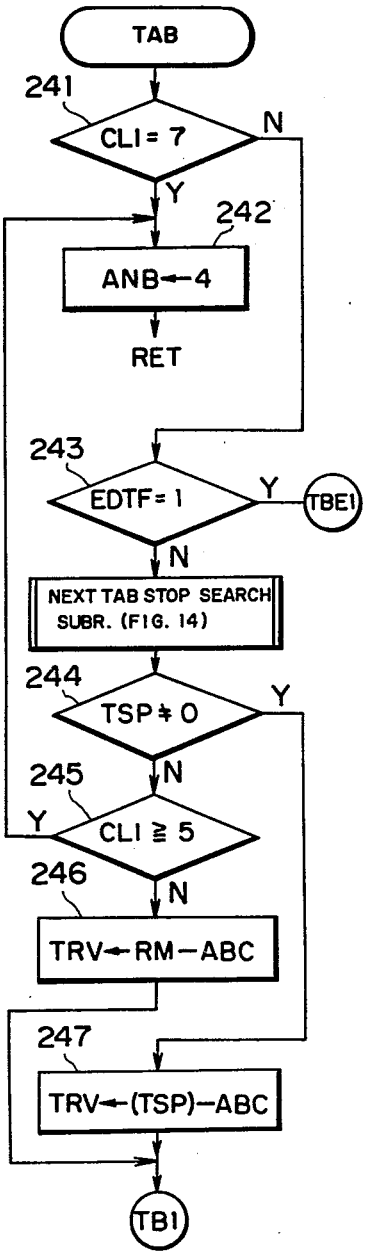
Figure 13B:
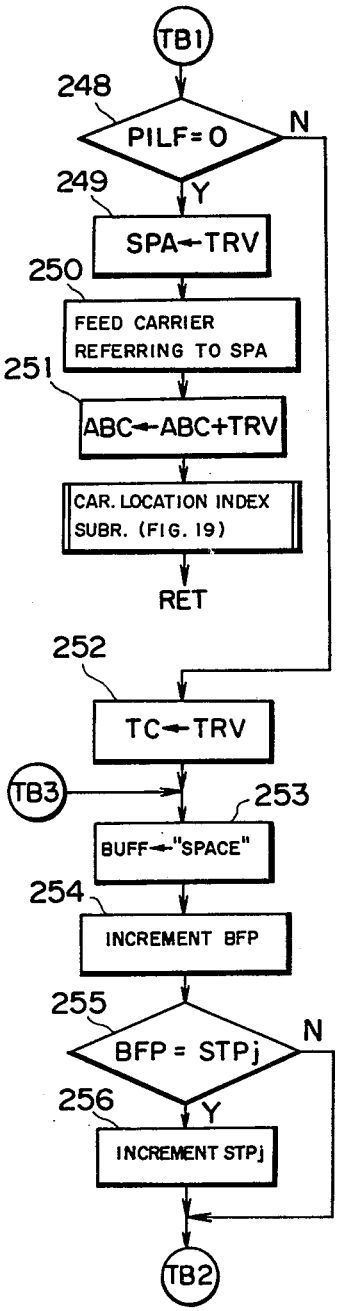
Figure 13C:
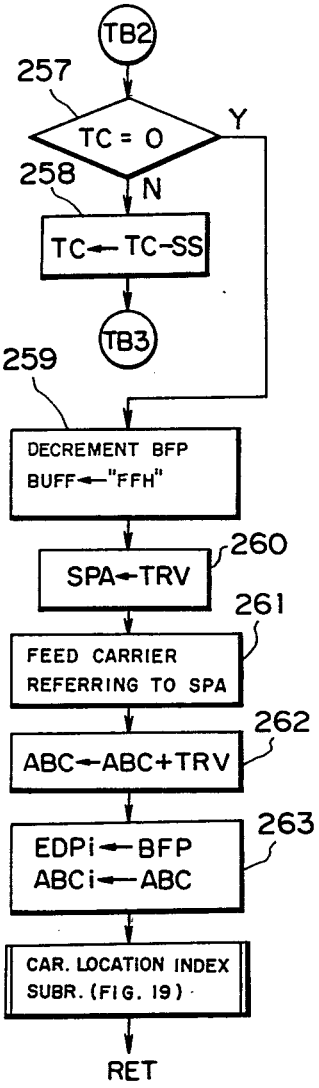
Figure 13D:
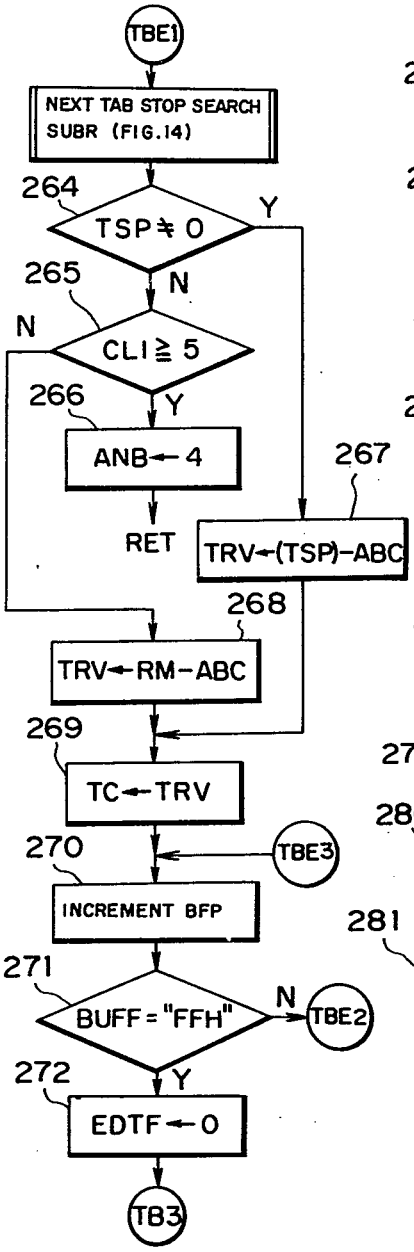
Figure 13E:
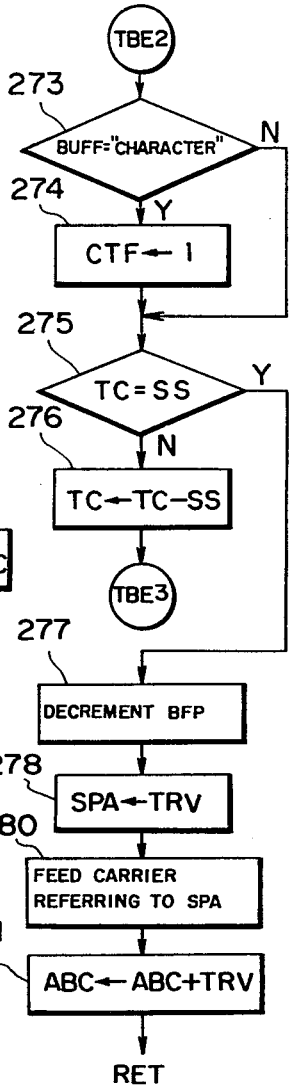

Operations of the typewriter of the present invention will be described in relation with the program of the microcomputer, of which a main routine is illustrated in FIG. 8 and subroutines in FIGS. 9 to 29. However, before going into a description of particular operations, it seems convenient that the buffers, buffer pointers and flags which are diagrammatically shown in these figures should be explained in alphabetical order. It is to be noted that the typewriter is designed such that up to 256 characters, both printed and deleted, in two lines can be stored in RAM, and the following terminology is employed for the convenience of explanation.

(1) The term "c-line" indicates a line in which a character can be printed;

(2) The term "i-line" indicates a line which contains a last printed character therein; and (3) The term "j-line" indicates a line of printed characters immediately preceding the i-line.

Thus, it is to be noted that a c-line coincides with an i-line where a character can be printed in a print line which contains a last printed character without effecting a line spacing operation, or in other words, the former is different from the latter until a first character is printed after any line feeding operation other than to a j-line. Thus, i- and j-lines each contain at least one printed character while a c-line may or may not contain a printed character therein.

Definition of Buffers, Pointers and Flags

ABC . . . Current print point register (2 bytes), which indicates a current position of the carrier along a print line at which a character can be printed, the count being represented in terms of a unit of 1/60 inch or 0.423 mm (space unit) from the leftmost limit position of the carrier.

ABCi, ABCj . . . i-line and j-line end point registers (2) bytes each), which respectively indicate i- and j-line end positions which are spaced from the last characters printed in the i- and j-lines by one character space, as counted in the same unit as of ABC. See FIG. 6.

ANB . . . Beep register, which can store three different counts each for identifying conditions of operation of the buzzer, of which ANB=1 is for a beep of "attention", 2 is for a beep of "ready", and 4 is for a beep of "error". ANB is cleared after completing the "beeping" step of the main routine.

Figure 5:
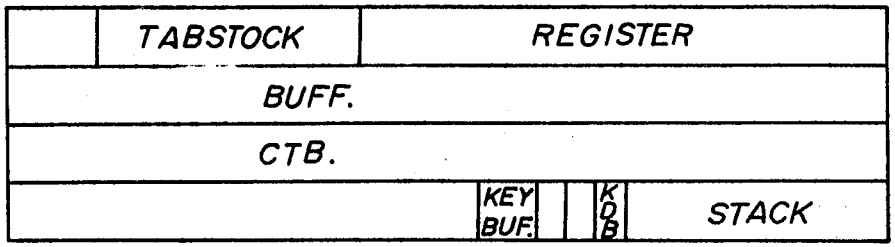
FIG. 5 is a format showing the structure of the RAM shown in FIG. 3.

BUFF . . . Output buffer, including 256 registers which are assumed to form a ring register and each can store therein a code of a different character, a "space" code, or an "end" code ("end" code denotes the end of a text for a print line stored in BUFF registers, and designated by "FFH" in the drawings), See RAM format of FIG. 5.

BFP . . . Buffer pointer, which specifies that one of the 256 BUFF registers into or from which a code is written or read. It is to be noted that "BUFF" represents that one of the 256 BUFF registers which is specified by BFP.

CA . . . Working register. No definition.

Figure 4:
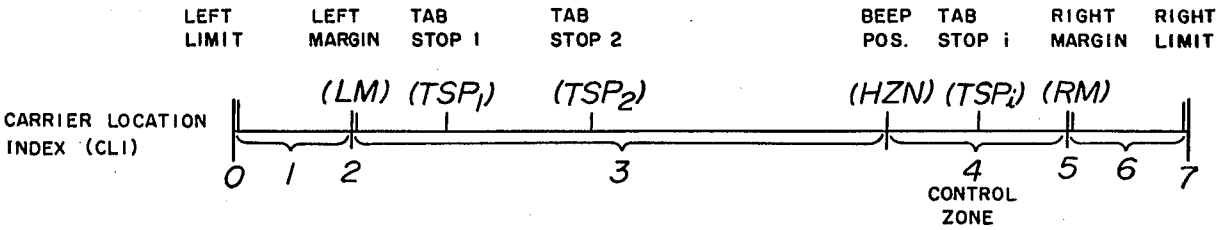
FIG. 4 is a diagrammatic illustration showing definitions of index numbers of carrier positions and zones.

CLI . . . Carrier location index register, which indicates an index of the position of the carrier relative to the format of a print line. As shown in FIG. 4, the leftmost limit position is indicated by "0", the positions between the leftmost limit and left margin (both exclusive) by "1", the left margin by "2", the positions between the left margin and the initial or leftmost point of the control zone (a "bell" or beeping position) (both exclusive) by "3", the positions in the control or "hot" zone (the right margine exclusive) by "4", the right margin by "5", the positions between the right margin and the rightmost limit position (both exclusive) by "6", and the rightmost limit position by "7". It is to be noted that the leftmost and rightmost limit positions "0" and "7" and the left and right margin positions "2" and "5" have a width corresponding to one character space according to the space pitch determined by the space selector 32: thus, the width is 6 units in pica or 10 pitch, 5 in elite or 12 pitch, and 4 in mini or 15 pitch.

CTB . . . Correct buffer, which has a similar arrangement of 256 registers which each can store therein a code of a different character, a space code or an end code. A text deleted by an automatic correcting operation is stored therein. See RAM format of FIG. 5.

CTBP . . . Correct buffer pointer, which specifies a particular one of CTB registers into or from which a code is written or read.

CTF . . . Correct enabled flag, which indicates whether or not automatic deletion of a printed character is possible. A printed character can be deleted or erased from a record sheet by mere depression of the correct key 18 when CTF=1 and cannot be deleted when CTF=0, and the correct LED is lit or left unilluminated accordingly.

DAZY . . . Key code register, which stores a pertinent code for calling a pertinent subroutine. The pertinent code is transferred thereto from that one of 15 key buffer registers for storing therein input data from the keyboard 1 which is specified by a key buffer pointer. The portion of the progran for transfer of input data to the key buffer and then to DAZY is not described herein since it is not involved in the present invention and can be easily derived by a person skilled in the art.

EDPi, EDPj . . . i-line and j-line end pointers, which specify those ones of the BUFF registers into or from which a code is written or read for the i- or j-line. Normally, an end code is stored in the BUFF registers specified by EDPi and EDPj.

EDTF . . . Edit flag, which indicates whether the typewriter is in edit mode (EDTF=1) or not (EDTF=0). "Edit" mode is a mode in which a current print point is involved in a text which has been already printed. Therefore, the typewriter is put into the edit mode by operation of the backspace key 12, express return key 14, and reverse line feed key 21 as will be described hereinafter, and the edit mode is cleared upon return to the text end position.

HZN . . . Beep or bell position register, which indicates the initial or leftmost position of the control zone mentioned hereinbefore, as counted in the same unit as of ABC.

Figure 6:
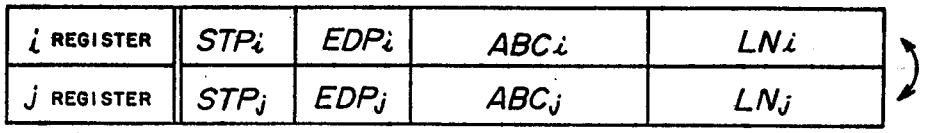
FIG. 6 is a format showing the structure of i- and j-registers of the RAM.
Figure 7:
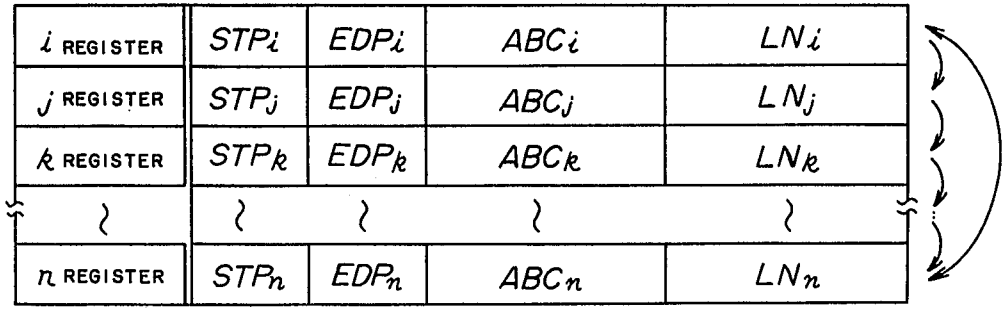
FIG. 7 is an alternative format showing the structure of i- to n-registers of the RAM.

INDF . . . Indent flag, which indicates whether the typewriter is in indent mode (INDF=1) or not (INDF=0). The indent LED on the indent key is lit on and off accordingly.

i-register . . . A group of registers, which store data of i-line and, as shown in FIG. 6, consist of the above-mentioned registers ABCi and EDPi and registers LNi and STPi which will appear hereinafter.

j-register . . . A group of registers, which store data of the j-line and, as shown in FIG. 6, consist of the above-mentioned registers ABCj and EDPj and registers LNj and STPj which will appear hereinlater. Since any modification of text data in BUFF registers (and also on the record sheet) including deletion and insertion of a character or characters is made only for the i-line in the embodiment described, the i- and j-lines are renamed one to the other or, in other words, contents of the j-registers and i-registers are exchanged when required. In the other embodiments, if the system should have a higher memory capacity for n lines (n is a natural number greater than 2), the contents of such line registers may be replaced in the order as indicated by arrows in FIG. 7.

KLN . . . c-line position register, which indicates the position of the c-line by a number counted from a particular line position in a unit of ½ line space (line space unit). If the c-line contains at least one printed character therein, that line becomes the i-line and thus KLN=LNi.

LNi, LNj . . . i- and j-line position registers, which indicate the positions of i- and j-lines, respectively, in a manner similar to KLN mentioned above.

LM . . . Left margin register (2 bytes), which stores data representative of the position to which the carrier is to return upon carrier return operation, as counted in the same space unit as of ABC. Thus, LM normally stores data of the left margin position.

LMS . . . Left margin save register (2 bytes), which saves the data of the left margin in the case of indented printing whereupon LM is to store the data of the initial position of the indented line (a tab stop position) in place of the left margin data. LMS is accessed upon clearing the indent mode to restore the left margin data into LM.

LS . . . Standard line space register, which indicates a standard line space as counted in the same unit as KLN mentioned above.

MRF . . . Margin release flag, which indicates whether the margin is to be released (MRF=1) or not (MRF=0). The content of MRF turns to "1" upon depression of the margin release key 30. If MRF=1, the carrier is enabled to move beyond the associated margin position.

NPF . . . No-print flag, which turns to "1" upon depression of the no-print key 22 and to "0" upon depression of the print key 23. When NPF=1, there occurs no printing operation even if a character key 10 is depressed. In this instance, however, other operations which accure from the character key depression are performed, including spacing operation and storage of data in BUFF.

PFA . . . Paper feed amount register, which indicates an amount by which a paper sheet is to be fed, including a sign specifying the direction of such feeding: when the sign is plus (+), the paper is fed in the forward direction whereas it is fed in the reverse direction when the sign is minus (−). Thus, the paper is fed a distance in accordance with the contents of PFA.

PILF . . . c-line print flag, which indicates whether the c-line contains a printed character (PILF=1) or not (PILF32 0).

RM . . . Right margin register, which indicates the position of the right margin.

SHP . . . Shift pointer, which specifies, in place of the above-mentioned BFP, that one of the BUFF registers into or from which a code is written or read in a data shifting operation as defined in the shift subroutine of FIG. 20.

SPA . . . Space amount register, which indicates an amount over which the carrier is to travel or move for spacing, backspacing and carrier return operations.

STPi, STPj . . . i- and j-line start pointers, which indicate those ones of the BUFF registers which store the first printed text data of the i- and j-lines, respectively, and define the printing data memory areas of the i- and j-lines in cooperation with the aforementioned EDPi and EDPj.

SS . . . Standard space register, which indicates the standard spacing amount of the carrier corresponding to one character space as calculated by the main routine of FIG. 8 determined by the space selector 32 and as counted in a unit of 1/60 inch or 0.423 mm(space unit) similarly to ABC. The spacing action which takes place in the printing and spacing operations is equivalent to one standard space.

TC . . . Working register. No definition.

TSP . . . Tab stop pointer, which specifies a particular one of up to 20-byte tab stock register couples into or from which a code is written or read (the system thus provides up to 20 tab stops settable). See RAM format of FIG. 5.

TRV . . . Tab distance register, which temporarily stores a calculated value of a distance over which the carrier is to travel in tabulating action or the like.

WRA . . . Working register. No definition.

PRINTING CHARACTERS

Normally, if any character key is operated, a corresponding character is printed on a record medium supported on the platen whereafter the carrier is fed rightwardly one character space. Such printing is carried out in the following sequence.

100 . . . The carrier at the right limit position? N (No)
101 . . . Edit mode? N
102 . . . The carrier at the right margin? N
107 . . . Disable margin release
108 . . . No printed character on c-line? and if c-line contains no printed character and hence a character is to be printed at the first position on a new print line, the operation proceeds to
109 . . . Place "1" in PILF
110 . . . Is c-line i-line? N
111 . . . Is c-line j-line? N
113 . . . Calculate the standard space according to the setting by the space selector 32 and place the result in SS
114 . . . Exchange the contents of i- and j-registers
115 . . . Rename c-line as i-line
116 . . . Set the start point for i-line next to the end point for j-line (i.e., designate that one of the BUFF registers which is next to the BUFF register which contains an end code for j-line as a BUFF register which is to store therein a first text data code, e.g., a character code, for i-line)
117 . . . Place the start point data (data representative of the BUFF register designated in the preceding step 116) for i-line in BFP
118 . . . Transfer data from DAZY to BUFF
119 . . . No-print key 22 depressed? N
120 . . . Print a character referring to DAZY (i.e., driving the type select motor 39 to rotate the type wheel 38 to selectively position a character to be printed to a print position, driving the hammer actuator 41 to effect impacting of the selected character type by the hammer with the ink ribbon lifted to the printed position by energization of the ink ribbon lift actuator 44, and then driving the ink ribbon feed actuator 43 to feed the ink ribbon an increment).

If c-line is identified as i-line in step 110, the steps 117 to 120 come after the step 110, and if c-line is identified as j-line, the step 111 is followed by

112 . . . Exchange the contents of i- and j-registers and then take the steps 117 to 120 given above.

After printing in this manner, the carrier 2 is spaced (fed rightward) a specified standard character space through the following sequence:

121 . . . Enable automatic correction
122 . . . Increment BFP and put an end code into BUFF
123 . . . Place the specified standard space count in SPA
124 . . . Feed the carrier referring to SPA (thus, by a specified standard character space).

The sequence is then followed by

125 . . . Increment SPA by the specified standard space count (consequently, SPA now contains a count representative of the new carrier position reached)
126 . . . Does BUFF contain a first text data code for j-line? N
128 . . . Take the current carrier position as the end position for i-line
129 . . . Does DAZY contain a "hyphen"?

If negative, the carrier location index (CLI) subroutine is called and then the character subroutine is ended. On the other hand, if the judgment is affirmative in step 126, it is followed by

127 . . . Increment STPj.

Also, if the judgment is affirmative in step 129, it is followed by

130 . . . Address the return mode selector 34
131 . . . The return mode selector in "AUTO 1" or "AUTO 2" position? N
132 . . . CLI equal to or larger than 4? N and then the carrier return (CR) subroutine of FIG. 23, which will be hereinafter described in detail in Return Mode Select, is called, and then the character subroutine is ended. If the judgment is negative in step 131 or 132, the CLI subroutine is also called whereafter the character subroutine is ended.

In step 102, if the current carrier position is the right margin, the carrier is returned after

103 . . . Address the return mode selector 34
104 . . . The selector in "AUTO 2" position? N
105 . . . Margin releasable? N
106 . . . Prepare for actuation of the buzzer for "attention"

Here, it is to be noted that, if a character key is depressed when the carrier is at the right margin (thus, CLI=5, see step 102) with the carrier return mode selector 34 set to the "AUTO 2" position (see step 104), the right margin is "automatically" released thereby to permit a character to be printed at a position rightwardly beyond the right margin position. Thus, with the selector 34 set to the "AUTO 2" position, characters can be printed successively beyond the right margin until either a hyphen is to be printed or spacing is to be effected without printing, as explained in the following Spacing Operation. In the mean time, the steps 135 to 143 in FIG. 9(*e*) will be hereinafter explained in detail in Edit Operation.

SPACING OPERATION

Normally, depression of the space bar 11 will result in feeding of the carrier one specified standard character space in the rightward direction without printing any character. In response to a "space" code, the space subroutine of FIG. 10 is called which includes the steps of

144 . . . The carrier at the right limit position? N
146 . . . Edit mode? N
147 . . . Address the return mode selector 34
148 . . . The selector 34 in "AUTO 1" or "AUTO 2" position? N
150 . . . The carrier at the right margin? N
152 . . . Disable margin release
153 . . . No characther in c-line?

and, if it is judged that there is no character, the sequence proceeds to

154 . . . Place the specified standard space count in SPA
155 . . . Feed the carrier referring to SPA
156 . . . Increment ABC by the specified standard space count.

On the other hand, if it is judged in step 153 that there is a character in c-line, it is followed by

157 . . . Place the specified standard space count in SPA
158 . . . Feed the carrier referring to SPA
159 . . . Increment ABC by the specified standard space count
160 . . . Place a "space" code in BUFF
161 . . . Increment BFP and place an end code in BUFF
162 . . . Take the current carrier position as the end position for i-line
163 . . . The carrier at the start position for j-line?

Figure 19A:
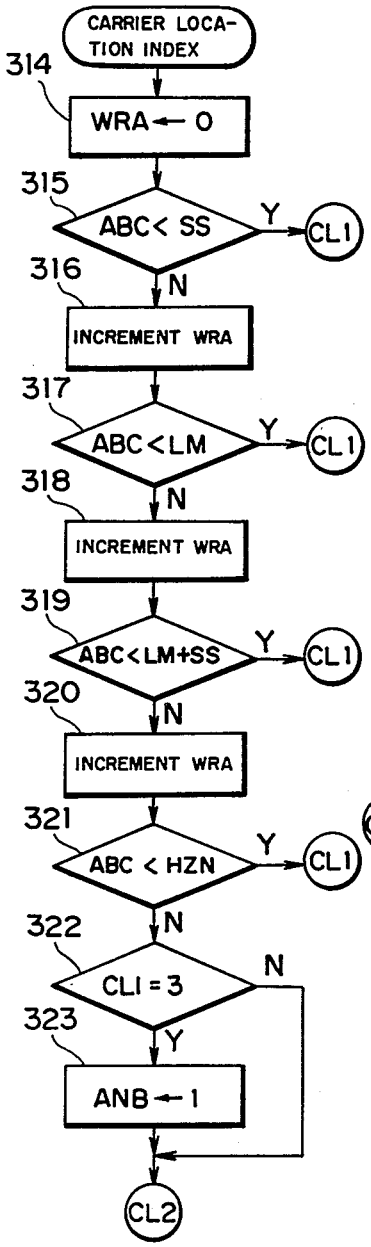
Figure 19B:
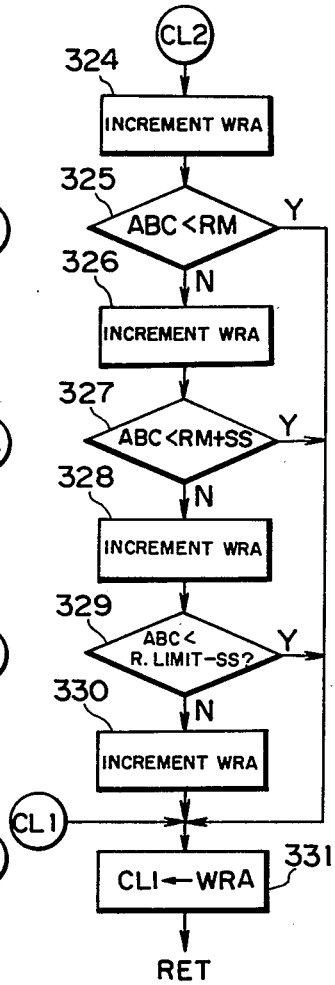

If affirmative, the carrier location index subroutine of FIG. 19 is called after

164 . . . Increment STPj whereas the step 164 is omitted if the result is negative in step 163. After execution of the CLI subroutine, the space subroutine comes to an end. Now, the CLI subroutine is described referring to FIG. 19. The sequence consists of

314 . . . Clear WRA to "0"
315 . . . The carrier at the left limit position (note that the left limit position has a width corresponding to the currently specified standard character space as determined by the space selector 32, as explained hereinbefore)? N
316 . . . Increment WRA (thus to "1")
317 . . . Is the carrier spaced leftwardly from the left margin position (which also has the same width as the left limit position)? N
318 . . . Increment WRA to "2"
319 . . . The carrier at the left margin? N
320 . . . Increment WRA to "3"
321 . . . Is the carrier spaced leftwardly from the beep (or bell) position (note that this position has no width since it is defined as the leftward extremity of the control zone)? N
322 . . . Is count of CLI "3", or is the carrier at the beep position? Y (Yes)
323 . . . Prepare for actuation of the buzzer for "attention"
324 . . . Increment WRA to "4"
325 . . . Is the carrier spaced leftwardly from the right margin (which also has the same width)? N
326 . . . Increment WRA to "5"
327 . . . The carrier at the right margin? N
328 . . . Increment WRA to "6"
329 . . . The carrier at the right limit position (which also has the same width)? N
330 . . . Increment WRA to "7"

If the judgment in step 315, 317, 319, 321, 325, 327 or 329 is affirmative (Y=yes), the CLI subroutine comes to an end after

331 . . . Place the count of WRA in CLI.

Figure 23:
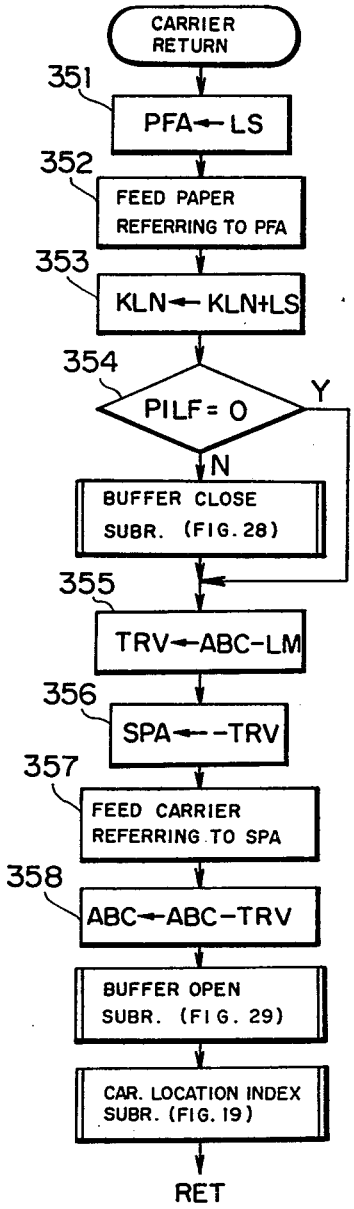

Referring again to FIG. 10, if the return mode selector 34 is identified in step 148 to be in "AUTO 1" or "AUTO 2" position, the carrier return subroutine of FIG. 23 is called after

149 . . . The carrier in or to the right of the control zone?

and then the space subroutine comes to an end. Thus, if the space bar 11 is operated when the carrier is in or to the right of the control zone with the carrier return mode selector 34 set to either the "AUTO 1" or "AUTO 2" position, the carrier return subroutine is called so that automatic carrier return is effected without effecting a spacing operation. It if further noted that, since, with the selector 34 set to the "AUTO 2" position, the right margin is automatically released upon depression of any character key, operation of the space bar 11 will cause the carrier to be automatically returned even from any position rightwardly of the control zone. Thus, in the described typewriter, the control zone is apparently considered to be elongated or extended up to the right limit position beyond which the carrier cannot travel rightwardly.

Also in step 144, if the carrier is at the right limit position, the space subroutine comes to an end after

145 . . . Prepare for actuation of the buzzer for "attention".

Further, if the machine is judged to be in edit mode in step 146, the sequence goes to

165 . . . Data in BUFF a "character"? Y
167 . . . Enable automatic correction
168 . . . Increment BFP
169 . . . Data in BUFF an end code? N
171 . . . Place the specified standard space count in SPA
172 . . . Feed the carrier referring to the SPA
173 . . . Increment ABC by the specified standard space count.

If the judgment is negative in step 165, automatic correction is not enabled, and if the judgment is affirmative in step 169, the carrier is fed through steps 171 to 173 after

170 . . . Clear the edit mode.

BACKSPACING OPERATION

Depression of the backspace key 12 will normally cause a backspacing operation, i.e., it will cause the carrier 2 to travel one specified standard character space in the backward or leftward direction. In response to a "backspace" code, the backspacing subroutine of FIG. 11 is called which includes the steps of

174 . . . The carrier at the left limit position? N
175 . . . Is BUFF the BUFF register for the first text code for i-line? N
176 . . . Edit mode? N
177 . . . c-line empty? N
178 . . . The carrier at the left margin? N 187 . . . Does the BUFF register immediately preceding to BUFF contain a "character" code (i.e., is there a printed character at a new carrier position after backspacing one character space)? N
181 . . . Place a negative specified standard space count in SPA
182 . . . Feed the carrier referring to the SPA
183 . . . Decrement BFP and decrement ABC by the standard space count
184 . . . Does BUFF contain a "space" code? Y
185 . . . Place an end code in BUFF
186 . . . Take the current carrier position as the end position for i-line.

Then, the CLI subroutine is called and executed whereafter the backspacing subroutine comes to an end. On the other hand, if the judgment is negative in step 184, steps 185 and 186 are bypassed and step 184 is directly followed by the CLI subroutine.

In step 187, if the judgment is affirmative, the carrier is backspaced through steps of
188 . . . Turn to the edit mode
189 . . . Same as in step 181
190 . . . Same as in step 182
191 . . . Same as in step 183 whereafter the CLI subroutine is called and executed and then the backspacing subroutine comes to an end. Thus, it may be apparent that the machine is brought into "edit" mode when the carrier is moved into an already printed area of the record sheet by an operation or operations of the backspace key 12.

In either case where the judgment is affirmative in step 175 or 177, that is, when the carrier is at the position corresponding to the first character printed for i-line, on one hand, and on the other hand, c-line has no character printed, the sequence proceeds to
192 . . . Disable automatic correction
193 . . . Edit mode? N
194 . . . The carrier at the left margin? N
197 . . . Take c-line as containing no printed characters
198 . . . Same as in step 181
199 . . . Same as in step 182
200 . . . Decrement ABC by the standard space count whereafter the CLI subroutine is called and executed and then the backspacing subroutine comes to an end.

If the judgment is affirmative in step 194, the backspacing subroutine comes to an end after
195 . . . Margin releasable? N
196 . . . Prepare for actuation of the buzzer for "attention" (because the carrier is at the left margin position and cannot be backspaced any more).

But, if the pertaining margin (i.e., left margin) is releasable in step 195, it is followed by the above-described step 197 so as to allow the carrier to be backspaced actually.

If it is judged in step 178 that the carrier is at the left margin position, the backspacing subroutine comes to an end after
179 . . . Margin released? N
180 . . . Prepare for actuation of the buzzer for "attention".

Also, if it is judged in step 174 that the carrier is in the left limit position and cannot be backspaced any more, the subroutine is passed through after step 180. Further, if the judgment is affirmative in step 176 and hence the machine is in "edit" mode, the sequence goes to the above-mentioned step 189 to effect appropriate backspacing operation.

If the judgment is affirmative in step 193 and hence the machine is in "edit" mode, the carrier is fed through the following steps.
201 . . . Same as in step 181.
202 . . . Same as in step 182.
203 . . . Same as in step 200.

Then, the shift subroutine of FIG. 20 which will be described hereinlater is called whereafter the sequence goes to
204 . . . Same as in step 160
205 . . . Does the BUFF register containing the last text data for i-line coincide with the BUFF register containing the first text data for j-line? Y
206 . . . Increment STPj whereafter the CLI subroutine is called and then the spacing subroutine comes to an end. Step 206 is bypassed when the judgment in step 205 is negative. The operation in this edit mode will be described in greater detail hereinlater in Edit Operation.

AUTOMATIC CORRECTING OPERATION

As described above, the correct LED when lit indicates that the current print line contains at least one character printed a code of which is stored in a BUFF register so that the printed character can be deleted from the print line or the record medium by mere operation of the correction key 18. Normally, depression of the key 18 will first cause the carrier to be fed one standard character space in the backward or leftward direction (backspacing) and then cause the print mechanism to effect printing of a character depending upon coded data accessed from BUFF but with the correcting ribbon lifted to the print position so that the printed character at the thus backspaced new position may be deleted from the record medium. The text data for the deleted character is also deleted from the BUFF register. If all the characters which are deletable by referring to the BUFF registers have been deleted and hence the current line contains no such printed characters therein, the correct LED is turned off to indicate that "automatic" correction (i.e., deletion) is impossible any more for the line.

Depression of the correction key 18 will cause the correct subroutine of FIG. 12 to be called and executed, which includes the steps of
207 . . . The carrier at the left limit position? N
208 . . . Automatic correction disabled? N
209 . . . Buff coincide with the BUFF register containing the first text data for i-line? N
210 . . . Place an end code in CTB
211 . . . Place the negative standard space count in SPA
212 . . . Feed the carrier referring to SPA (thus, backspace one standard character space)
213 . . . Decrement BFP and decrement ABC by the standard space count
214 . . . BUFF contain a "character" code? Y
215 . . . Place the data of BUFF in DAZY
216 . . . Erase or delete the printed character referring to DAZY and NPF (i.e., driving the type select motor 39 to rotate the type wheel 38 to selectively position the character to be deleted to the print position, and driving the hammer actuator 41 to effect impacting of the selected character type by the hammer with the correction ribbon lifted to the printing position by energization of the correction ribbon lift actuator 46. The correction ribbon is fed by a suitable mechanism upon lifting thereof, as described before. If NPF=1, such deleting operation will not occur.)

217 . . . Place a "correct" code in DAZY
218 . . . Decrement CTBP and place the data of BUFF in CTB
219 . . . Edit mode? N
221 . . . Place an end code in BUFF
222 . . . Take BUFF and the current carrier position as the BUFF register containing the last text data and the end position for i-line, respectively.

Here, in order to enable such a foregoing automatic deleting operation to be repeated if and while the repeat key 17 is depressed (note that the repeat key 17 is provided for repetition of any and last typewriter operation, such as printing a character, spacing, backspacing and so on), the repeat key 17 is accessed after the key buffers (refer to DAZY for Definition of Buffers, Pointers and Flags above) has been accessed. Thus, the sequence proceeds to 223 . . . Specified key buffer register contain any input data? N
224 . . . Access repeat key 17
225 . . . Repeat key 17 depressed? Y
227 . . . Buff coincide with the BUFF register containing the first text data for i-line? N
228 . . . DAZY contain a "correct"code?

and if affirmative in step 228, it is followed by the foregoing step 211 for a second deleting operation. But, if negative in step 228, the automatic correction subroutine comes to an end after call of the CLI subroutine. Also, when the judgment is affirmative in step 227, that is, when the first position for i-line is reached by an automatic correcting operation, the sequence goes to 229 . . . DAZY contain a "correct" code?

If negative, the subroutine is passed through after call of the LSI subroutine. Thus, depression of any key other than the correct key 18 and the repeat key 17 will cause the automatic correction subroutine to be passed through. If the judgment is affirmative in step 229, the sequence goes to a following step 230, which will be described below.

If the judgment is affirmative in step 223, it is followed by

226 . . . Encode the key input data and store same in DAZY which step is in turn followed by the above-mentioned step 226.

In step 209, if it is judged that BUFF coincides with the BUFF register containing the first text data for i-line, the sequence goes to 230 . . . j-line empty? N
231 . . . Exchange the data of i- and j-lines
232 . . . Is c-line i-line?

If negative, the sequence continues to

233 . . . Place in PFA the difference of i- from c-line position
234 . . . Feed the paper sheet referring to PFA
235 . . . Rename i-line as c-line After indexing to the former j-line through these steps 233 to 235, or without going through these steps in case of i-line, the relocate subroutine of FIG. 16, which will be hereinlater described in detail, is called and executed, whereby the carrier is traversed to the end position for the former j-line which position is subsequent next to the position of the last character printed. The automatic correction subroutine comes to an end after 236 . . . Disable automatic correction
237 . . . Take c-line as having printed characters.

These steps 230 to 237 provide for a continuous automatic deleting operation across two successive print lines: when, for example, the first printed character in i-line has been deleted (which ensure the affirmative judgment in step 209) and the repeat key 17 is depressed, then the paper sheet is indexed to the previous print line (steps 231 to 235) and the carrier is moved to the end position for the new indexed line (the relocate subroutine), allowing successive deletion of printed characters in this print line. If the previous line (j-line) has no printed characters in such conditions as, for example, in the just-described exemplary case, the record sheet remains at or is indexed to i-line (again, i-line is the print line which normally contains the last printed character) and also the carrier is moved to the end position for i-line. These operations are attained by the same steps 232 to 237 after a single step 238 . . . i-line empty? N when the judgment in step 230 is affirmative. Thus, it may be apparent that continuous or successive depression of the repeat key 17 just after depression of the correct key 18 can delete all the printed characters contained in last two print lines.

If the judgment is affirmative in step 238 and hence neither i-line nor j-line has any printed character therein, the automatic correction subroutine is passed through after 239 . . . Disable automatic correction
240 . . . Take c-line as having printed characters.

If the typewriter is in the edit mode in step 219 (which will be described hereinlater in Editing Operation), the sequence goes to 220 . . . Place the "space" code in BUFF and then to the above-mentioned step 223.

MANUAL CORRECTING OPERATION

A printed character data of which has already been deleted from a BUFF register, such as a character which is in the second preceding print line, cannot be erased by the just described Automatic Correcting Operation, and a "manual" correcting operation is employed. The carrier is fed to an arbitrary character to be erased by operating a suitable key or keys such as, for example, the reverse paper feed key 21, space bar 11, backspace key 12, and so on, and then the correct key 18 and code key 31 are depressed simultaneously for correction. Simultaneous depression of both keys 18 and 31 will cause the manual correct subroutine of FIG. 21 to be called, which includes the steps of 341 . . . Key input data present? Y
342 . . . "Character" data? Y
344 . . . Encode the "character" data and place same in DAZY
345 . . . Erase the printed character referring to DAZY (refer to step 216)

and this subroutine is passed through. If the judgment is negative in step 342, this subroutine is passed through after 343 . . . Prepare for actuation of the buzzer for "error".

TABULATING OPERATION

Figures 14, 15A, 15B:
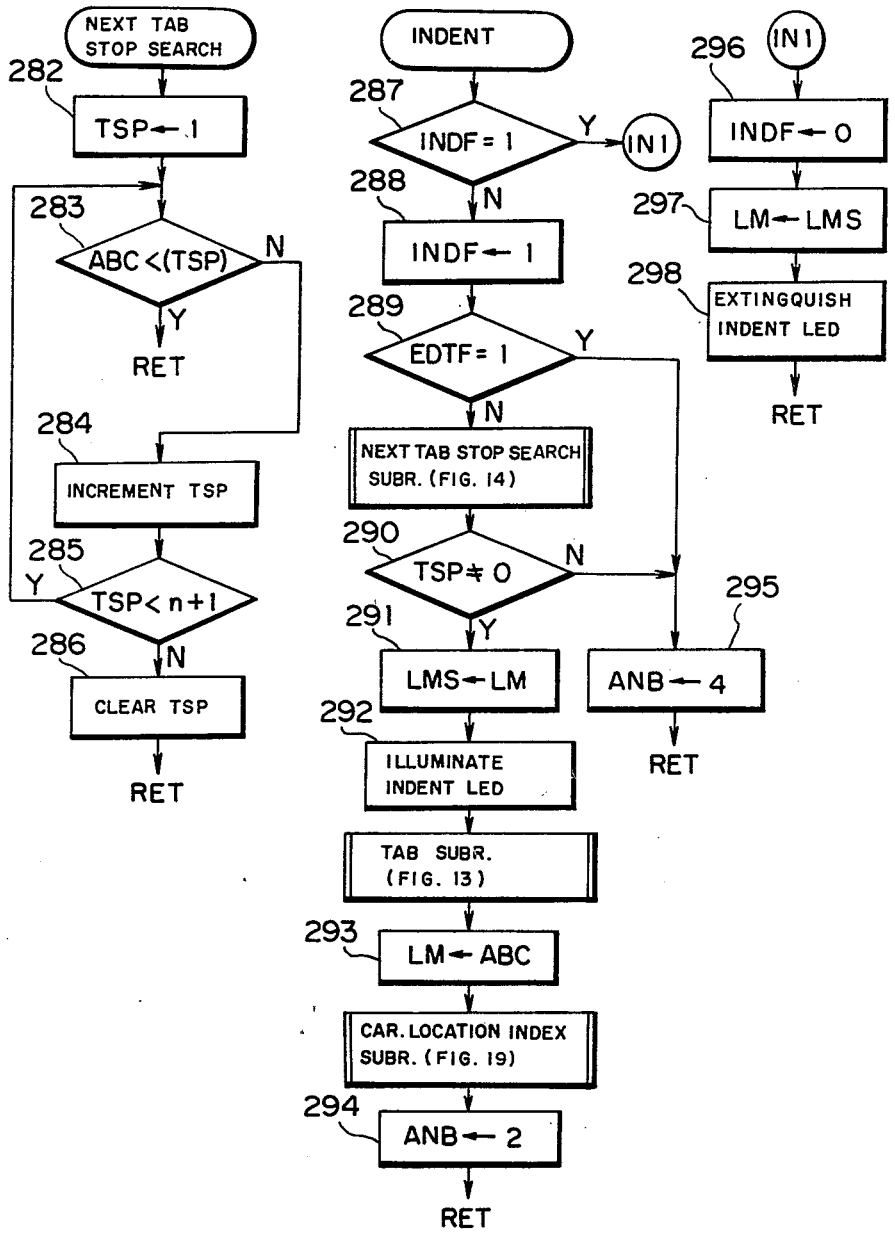
Figure 16:
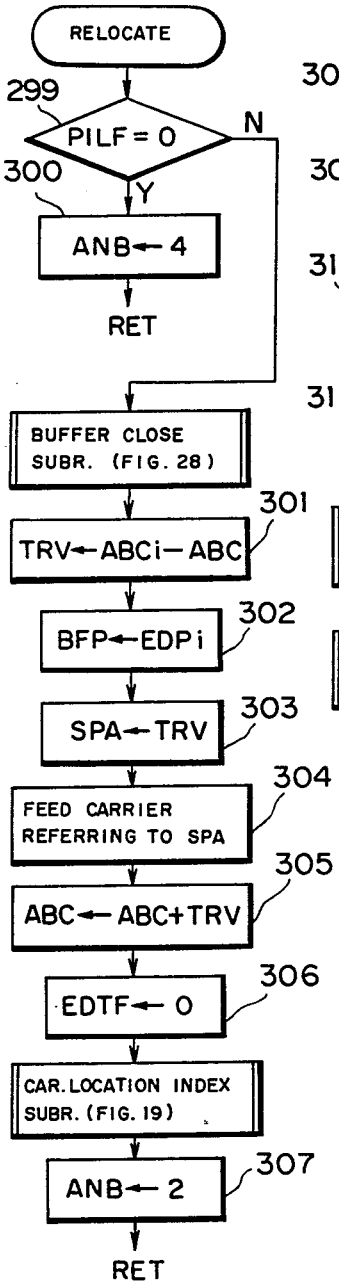
Figure 17:
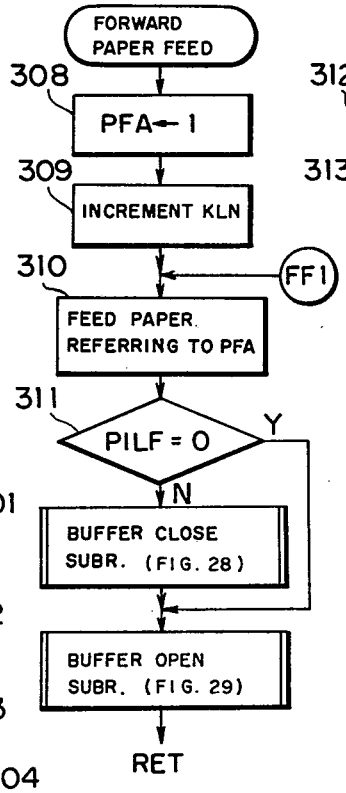

Normally, depression of the tab key 26 will cause a tabulating operation to be performed. Information of tab stops set by an operator is electronically stored in coded form in the tab stock area of RAM (see RAM format of FIG. 5). Upon depression of the tab key 26, a subsequent next tab stop is first searched and then the carrier is fed to the subsequent next tab stop position. The tab subroutine for providing such a tabulating operation includes, as shown in FIG. 13, the steps of 241 . . . The carrier at the right limit position? N
243 . . . Edit mode? N
and then the next tab stop search subroutine of FIG. 14 is called. If there is no tab setting (no tab stop) found through the search subroutine,
244 . . . Next tab stop present? N
245 . . . The carrier at or to the right of the right margin? N
246 . . . Place in TRV the difference (distance) from the right margin to the current carrier position
248 . . . c-line empty? Y
249 . . . Place the data of TRV in SPA
250 . . . Feed the carrier referring to SPA
251 . . . Add the data of TRV to the current carrier position data and place the results in ABC
and the tab subroutine is passed through after call of the CLI subroutine. Thus, when there is no tab setting and the carrier is currently positioned leftwardly of the right margin, the carrier is fed to the right margin position.

If the judgment in step 244 is affirmative and hence there is a tab setting (the count of TSP designates the number in order of the next subsequent tab stop as counted from the left and simultaneously of the pertaining tab stock register couple), the sequence goes to
247 . . . Place in TRV the difference from the current carrier position to the next tab stop position
and the carrier is fed to the next subsequent tab stop through the steps 248 to 251.

If the carrier is at the right limit position in step 241, the tab subroutine is passed through after
242 . . . Prepare for actuation of the buzzer for "error".

If it is judged in step 248 that there is a printed character in c-line, the sequence goes to
252 . . . Place the data of TRV in TC
253 . . . Place a "space" code in BUFF
254 . . . Increment BFP
255 . . . BUFF contain the first text data for j-line? Y
256 . . . Increment STPj
257 . . . Data of TC "0"? N
258 . . . Decrement TC by the standard space count
and then goes back to step 253. Thus, "space" codes are stored in BUFF registers until the carrier is fed to the next subsequent tab stop position which has been searched by calling the next tab stop search subroutine of FIG. 14.

The search subroutine starts with
282 . . . Place "1" in TSP
283 . . . The carrier positioned to the right of the position of the tab stop specified by TSP? N
284 . . . Increment TSP
285 . . . Data of TSP smaller than n+1 (here, n indicates the maximum number of tab stop settings as determined by the system, and in this embodiment, =20)?
Thus, the 1st to 20th tab stop settings (see FIG. 4) may be sequentially checked in response to depression of the tab key 26, and the tab setting when the judgment in step 283 is first turned into affirmative is the subsequent next tab stop since the carrier position is counted as the distance from the left limit position. The next tab stop search subroutine is passed through if the judgment is affirmative in step 283. On the other hand, when it is found that any of tab settings is not the next tab stop and hence the judgment in step 285 is finally negative, the next tab stop search subroutine comes to an end after
286 . . . Clear TSP to zero Referring again to FIG. 13, if it is judged in step 257 that the count of TC is reduced to "0", that is to say, if the carrier reaches the next subsequent tab stop position, the sequence advances to
259 . . . Decrement BFP and place an end code in BUFF
260 . . . Place the data of TRV in SPA
261 . . . Feed the carrier referring to SPA
262 . . . Add the data of TRV to the current carrier position data and place the results in ABC
263 . . . Take BUFF and the current carrier position as the BUFF register containing the end text data and the end position for i-line, respectively
and the tab subroutine is passed through after calling the CLI subroutine of FIG. 19.

On the other hand, if it is judged in step 243 that the machine is in the edit mode, after calling the above-mentioned right tab stop search subroutine, the sequence is branched to
264 . . . Next tab stop present? Y
267 . . . Place in TRV the difference from the current carrier position to the next tab stop position
269 . . . Place the data of TRV in TC
270 . . . Increment BFP
271 . . . Data of BUFF an end code? N
273 . . . BUFF contain a "character"? Y
274 . . . Enable automatic correction
275 . . . Data of TC equal to the specified standard space count? N
276 . . . Decrement TC by the standard space count
and then to step 270 again to repeat the same operation.

If the judgment in step 273 is negative, the step 274 is bypassed.

If it is judged in step 275 that the data in TC is equal to the specified standard space count, the sequence goes to
277 . . . Decrement BUFF
278 . . . Place the data of TRV in SPA
280 . . . Feed the carrier referring to SPA
281 . . . Add the data of TRV to the current carrier position data and place the results in ABC
and then, the tab subroutine is passed through.

If the data of BUFF is an end code in step 271, the sequence goes to
272 . . . Clear the edit mode
and then to step 253 again to place a "space" code in BUFF in a similar manner.

If it is judged in step 264 that there is no next tab stop, the sequence goes to
265 . . . The carrier at or to the right of the right margin? N
268 . . . Place in TRV the diatance from the current carrier position to the right margin
and then to step 269. If the judgment is affirmative in step 265, the tab subroutine comes to an end after
266 . . . Prepare for actuation of the buzzer for "error".

INDENTING OPERATION

First depression of the indent key 27 will cause an indenting operation to be carried out and the indent LED 37 to be lit. In the indenting operation of the presently described typewriter, the subsequent next tab stop is first searched and then the carrier is fed to the subsequent next tab stop position. Such position is thereafter regarded by the electronic control device as an apparent left margin to which the carrier must return by a carrier return operation. The new approach thus eliminates the necessity of operations for bringing the carrier to an intended indenting position, such as, for example, spacing operations. Second depression of the indent key 27 will result in switching off of the indent LED 27 and clearing of the indent mode so that the original or "true" left margin will be restored. The indenting operation is provided by the indent subroutine of FIG. 15, which includes the steps of

287 . . . Indent mode? N
288 . . . Turn to the indent mode
289 . . . Edit mode? N Here, the next tab stop search subroutine of FIG. 14 is called, and then the sequence goes to

290 . . . Next tab stop present? Y
291 . . . Store the left margin data in LMS
292 . . . Prepare for illumination of the indent LED 37 and here the tab subroutine of FIG. 13 is called to feed the carrier to the next tab stop position in the above-described manner, followed by

293 . . . Prepare for actuation of the buzzer for "set"

A second depression of the indent key results in the affirmative judgment in step 287, and the sequence is thus branched to

296 . . . Clear the indent mode
297 . . . Transfer the data of LMS back to LM
298 . . . Prepare for switching off of the indent LED and the indent subroutine is ended.

It it is judged in step 289 that the typewriter is in the edit mode or in step 290 that there is no next tab setting, the indent subroutine is passed through after

295 . . . Prepare for actuation of the buzzer for "error".

RELOCATING OPERATION

Depression of the relocate key 19 will normally cause the print point or carrier to move to the end position of the current print line where the current print line is either i- or j-line, or in other words, where the text of printed characters is held in BUFF registers. By depression of the relocate key 19, the relocate subroutine of FIG. 16 will be called, which includes the steps of

Figure 28:
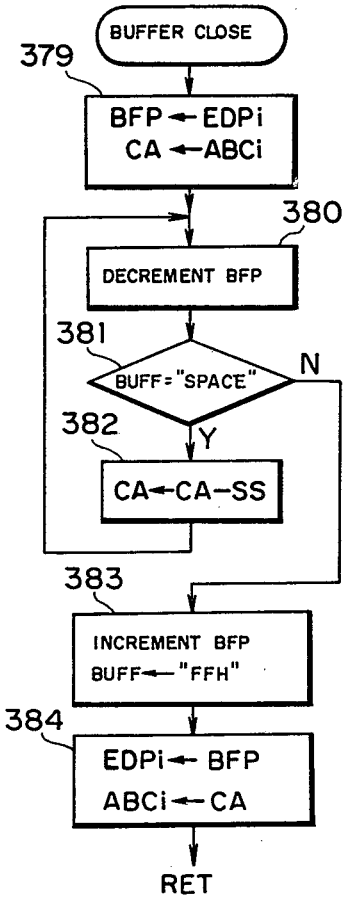

299 . . . c-line empty? Y and here the buffer close subroutine of FIG. 28, which will be hereinlater described, followed by the sequence of

301 . . . Place in TRV the difference from the current carrier position to the end position for i-line
302 . . . Place the data of EDPi and BFP
303 . . . Place the data of TRV in SPA
304 . . . Feed the carrier referring to SPA
305 . . . Add the data of TRV to the data of ABC and store the results in ABC.

Through these steps 301 to 305, the carrier is fed to the end position for i-line. The sequence further continues to

306 . . . Clear the edit mode whereafter the CLI subroutine is called, and the subroutine is passed through after

307 . . . Prepare for actuation of the buzzer for "set".

If it is judged in step 299 that there is no printed character in i-line, the indent subroutine comes to an end after

300 . . . Prepare for actuation of the buzzer for "error".

FORWARD PAPER FEEDING OPERATION

The paper feeding operation involved in the carrier return operation will be dealt with hereinafter in Carrier Return Operation. What is described here is the forward line feed operation which is performed in response to depression of the paper feed key 20. Depression of the paper feed key 20 will cause the paper to be fed one unit line space (see Definition of Buffers, Pointers and Flags) in the forward direction. Such paper feeding operation is provided by the forward paper feed subroutine of FIG. 17, in which the sequence proceeds to

308 . . . Place "+1" in PFA
309 . . . Increment KLN
310 . . . Feed the paper referring to PFA thereby feeding the paper in the forward direction, and then going to
311 . . . c-line empty?

and if negative, then the buffer close subroutine of FIG. 28, which will be described hereinlater, is called which, however, is bypassed if the judgment in step 311 is affirmative. The forward paper feed subroutine is then passed through after calling the buffer open subroutine of FIG. 29, which will also be described hereinlater.

REVERSE PAPER FEEDING OPERATION

Figure 18:
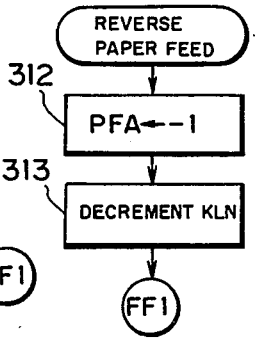

Depression of the reverse paper feed key 21 will cause the record paper to be fed in the reverse direction, and such reverse paper feeding operation is also performed in the Automatic Correcting Operation as described hereinbefore. By depression of the reverse paper feed key 21, the reverse paper feed subroutine of FIG. 18 is called, in which the sequence proceeds to

312 . . . Place "−1" in PFA
313 . . . Decrement KLN then going to step 310 of the forward paper feed subroutine of FIG. 17 described hereinbefore. Thereafter the control is returned in the same manner as in Forward Paper Feeding Operation.

CONTROL ZONE SETTING OPERATION

Figure 22:
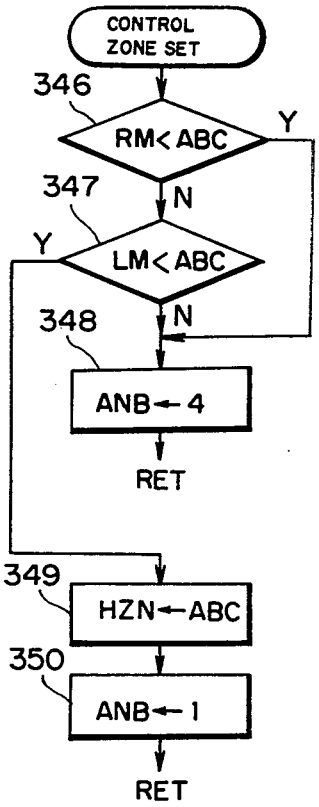

This operation is performed by simultaneous depression of the right margin setting key 29 and code key 31 and will now be described with reference to the control zone setting subroutine of FIG. 22 which is called upon depression of those keys. The control zone setting subroutine includes the steps of

346 . . . The carrier to the right of the right margin? N
347 . . . The carrier to the right of the left margin? Y
349 . . . Place the current carrier position data in HZN thus as the initial position (beep position) of the control zone
350 . . . Prepare for actuation of the buzzer for "note"

and the subroutine is passed through. If it is judged in step 346 that the carrier is currently located to the right of the right margin, the subroutine comes to an end after

348 . . . Prepare for actuation of the buzzer for "error".

Thus, the bell or beep position and hence the control zone are defined by the carrier position upon simultaneous depression of the right margin set key 29 and code key 31 where the carrier is positioned between the left margin position (exclusive) and the right margin position (inclusive).

The setting of the left and right margins by the left and right margin setting keys 28 and 29, respectively, and the setting of tab stops by the tab set key 24 (as well as the tab clearing by the tab clear key 25) are effected similarly by depression of the pertaining key with the carrier 2 positioned at an appropriate position and may thus be provided by respective subroutines which are not shown in the drawings as such programs may be easily derived by those skilled in the art and are not involved in the present invention.

CARRIER RETURN OPERATION

Normally, the carrier is returned to the left margin position by operating the carrier return/line space key 113. Such carrier return operation is provided by the carrier return subroutine of FIG. 23, in which the sequence proceeds to 351 . . . Place the standard line feed count in PFA 352 . . . Feed the paper referring to PFA 353 . . . Increment KLN by the standard line feed count thereby feeding the paper by one standard line space, and then going to 354 . . . c-line empty?

It is to be noted that, since PILF is not yet updated before step 354 after line feeding operation by step 352, the c-line is not the new and current line as specified by KLN (refer to Definition of Buffers, Pointers and Flags hereinbefore) after such line feeding but the previous line, i.e., the "c-line" before such line feeding which line may or may not be i-line. Thus, if the judgment in step 354 is negative and hence the "c-line" contains at least one character printed, the buffer close subroutine of FIG. 28 is called, which is bypassed when the judgment in step 354 is otherwise affirmative. Thereafter, the sequence goes to 355 . . . Place in TRV the difference or distance from the left margin to the current carrier position 356 . . . Place in SPA the contents of TRV with the negative sign (−)

357 . . . Feed the carrier referring to SPA

358 . . . Subtract the carrier feed amount from the current carrier position and store the results in ABC.

Figure 29A:
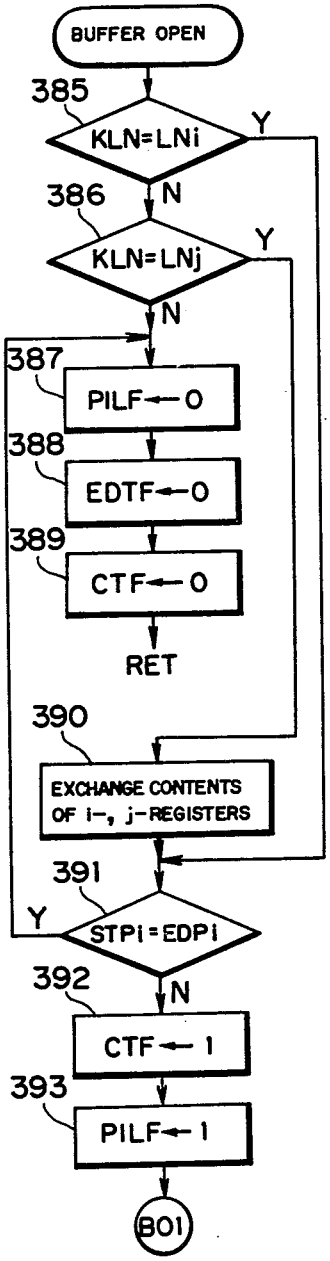
Figure 29B:
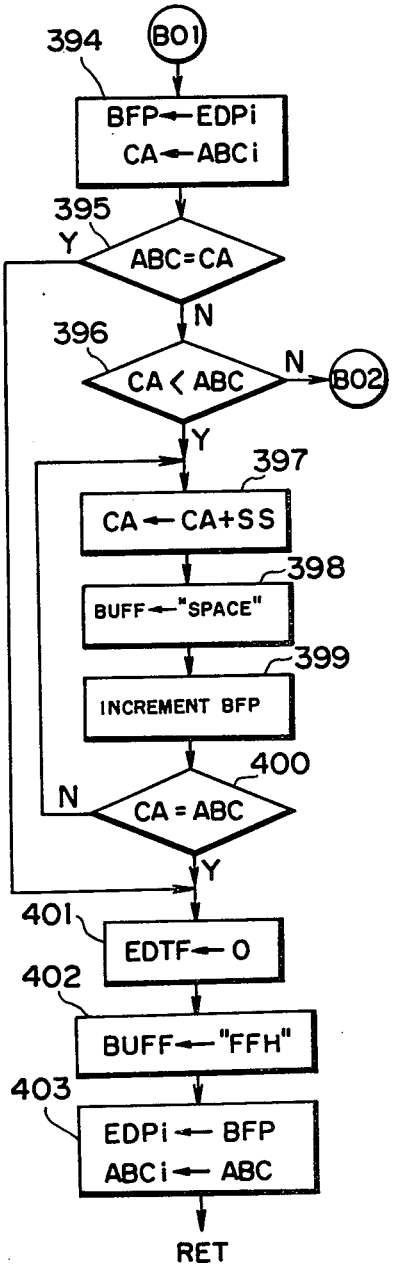
Figure 29C:
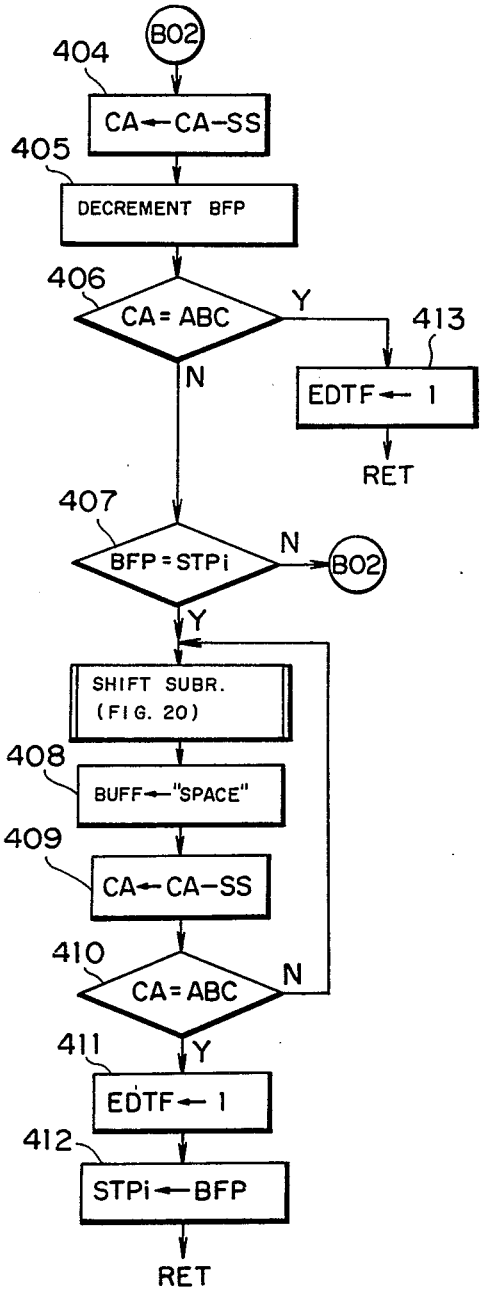

Then, the buffer open subroutine of FIG. 29 which will be described hereinafter and the aforementioned carrier location index subroutine of FIG. 19 are called in order, and then carrier return subroutine is passed through. Through these steps, the carrier is returned to the left margin or indent position as currently specified by LM.

Generally, any spacing or tabulating operation after the last character has been printed for c-line (in this case, i-line) prior to line feeding is considered to be of no use or in error, it may be preferable to remove any such "space" code from BUFF registers so that the carrier position next to the last printed character may be considered the end position for the print line. An approach to this operation is attained by the buffer close subroutine of FIG. 28 in which the sequence proceeds to 379 . . . Place data of EDPi in BUFF and place data of ABCi in CA 380 . . . Decrement BFP 381 . . . BUFF contain a "space" code?

and if affirmative

382 . . . Decrement CA by the standard space count and again to step 380 to repeat the similar operation, decrementing the buffer pointer until BUFF contains a text code other than a "space" code, that is to say, passing by "space" containing BUFF registers for i-line toward the first character containing BUFF register until a "character" appears in BUFF (note that a BUFF register can contain only a character, space or end code). The buffer close subroutine is then passed through after 383 . . . Increment BFP and place an end code in BUFF 384 . . . Place the data of BFP in EDPi and place the data of CA in ABCi.

On the other hand, if a new line after such line feeding coincides with either i- or j-line, such new line must contain at least one character printed and the carrier may be differently located relative to the new line than to the previous line. Accordingly, the control must be able to cope with such possible various line conditions. Thus, the buffer open subroutine of FIG. 29 is provided.

In this subroutine, whether the new line is either i- or j-line or else a different line is first checked. Thus:

385 . . . Is c-line i-line?

386 . . . Is c-line j-line?

In case the new line is a different line than i- and j-lines and judgment is thus negative in both steps, the subroutine is passed through after 387 . . . Take c-line as containing no printed characters 388 . . . Clear the edit mode 389 . . . Disable automatic correction.

On the other hand, if the new line is j-line, it is renamed as i-line by step

390 . . . Exchange the data of i- and j-registers which step is bypassed if the new line is i-line, and then the sequence goes to 391 . . . First printed character position for i-line coincide with the end position for i-line (or, i-line emptied)?

and if affirmative, the sequence goes to step 387 described above.

If the judgment is negative in step 391, the sequence goes to

392 . . . Enable automatic correction

393 . . . Take c-line as having a printed character

394 . . . Place the data of EDPi and ABCi and BFP and CA, respectively and then to 395 . . . Current carrier position correspond to the data of CA (with the position next to the last printed character, i.e., the end position, for i-line)?

If affirmative, the subroutine is passed through after

401 . . . Clear the edit mode

402 . . . Place an end code in BUFF

403 . . . Same as in step 384.

On the other hand, if the judgment is negative in step 395, the sequence is continued to 396 . . . Current carrier position data greater than the data of CA (or, the carrier located rightwardly of the end position for i-line)?

and if affirmative, to

397 . . . Increment CA by the standard space count

398 . . . Place a "space" code in BUFF

399 . . . Increment BFP

400 . . . Current carrier position data coincide with the data of CA?

If negative in step 400, a loop of the steps 397 to 400 is repeated. Thus, "space" codes will be placed in BUFF registers until the loop is passed through when the contents of CA and ABC are coincided with each other and hence the end position for i-line is apparently advanced to the current carrier position. If the judgment turns into affirmative in step 400, the sequence goes to step 401 described above.

If the judgment is negative in step 396 and hence the carrier is currently located leftwardly of the end position for i-line, the sequence branches to 404 . . . Decrement CA by the standard space count 405 . . . Decrement BFP 406 . . . Current carrier position data coincide with the data of CA?

and if negative, to

407 . . . BUFF contain the first text data for i-line?

and if negative here again, the sequence goes back to step 404 so that a loop of the steps 404 to 407 will be repeated. This loop will be passed through when the judgment turns into affirmative either in step 406 or 407.

In the former case, that is, when the carrier is apparently backspaced from the end position for i-line to the current carrier position which is between the first and end positions for i-line, the subroutine is passed through after

413 . . . Turn to the edit mode.

In the latter case, that is, when the carrier is currently located leftwardly of and hence outside the first position for i-line, or in other words, when the carrier is apparently backspaced leftwardly beyond the first printed character for i-line, the shift subroutine is called, the purpose of which is to reserve a BUFF register for possible input text data of which an additional text is printed leftwardly of the first printed character for i-line (note that such reservation is required since the BUFF register containing the first text data for i-line is normally subsequent next in the BUFF register ring to the BUFF register containing the end code for j-line). In the shift subroutine, the array of the entire text data for i-line is shifted "one BUFF register" in the ring, or in other words, every text data for i-line is shifted from one to the subsequent next BUFF register in the BUFF register ring thereby to obtain an empty BUFF register between the first text data containing BUFF register for i-line and the end code containing BUFF register for j-line.

Figure 20:
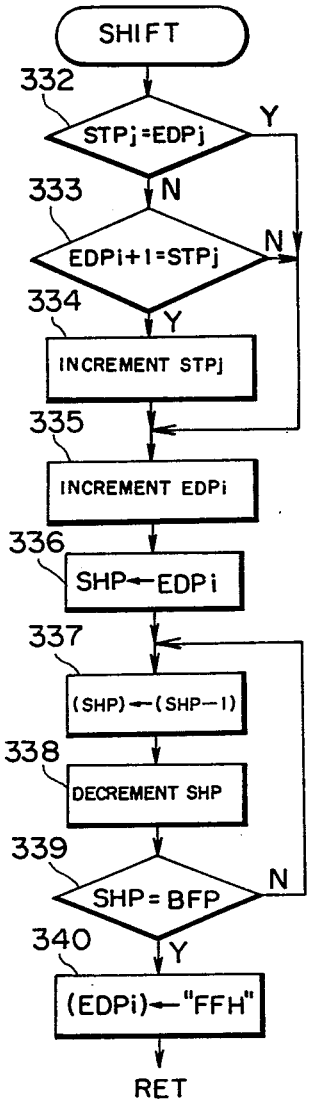
Figure 21:
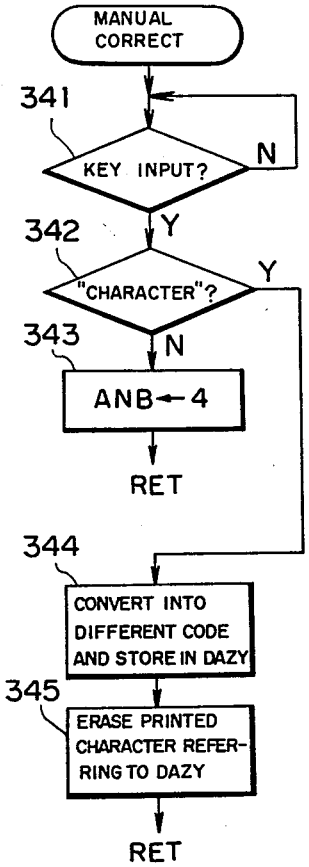

In particular, referring to FIG. 20, the shift subroutine includes the steps of

332 . . . j-line emptied? N

333 . . . BUFF register containing the end code for i-line directly precede the BUFF register containing the first text data for j-line? Y

334 . . . Increment STPj

335 . . . Increment EDPi

336 . . . Place the data of EDPi in SHP

337 . . . Place in particular BUFF register specified by SHP contents of BUFF register directly preceding the particular BUFF register

338 . . . Decrement SHP

339 . . . Data of SHP coincide with the data of BFP (shift completed)? N

340 . . . Place an end code in BUFF register specified by EDPi and then the subroutine is passed through.

If it is judged in step 332 that j-line is emptied, the sequence goes to step 335 bypassing steps 333 and 334. Also, if the judgment is negative in step 333, the operation proceeds to step 335 bypassing step 334.

Referring again to FIG. 29, after completion of the shift subroutine, the sequence goes to

408 . . . Place an "space" code in BUFF

409 . . . Decrement CA by the standard space count

410 . . . Current carrier position coincide with the data of CA and if negative and hence another apparent backspacing is required, the shift subroutine is called again to make text data shifting in the same manner as described above, repeating the operation of placing a "space" code in BUFF until the carrier is apparently backspaced to the current carrier position. And then the subroutine is passed through after

411 . . . Turn to edit mode

412 . . . Place the data of BFP in STPi.

EXPRESS RETURN OPERATION

Figure 27:
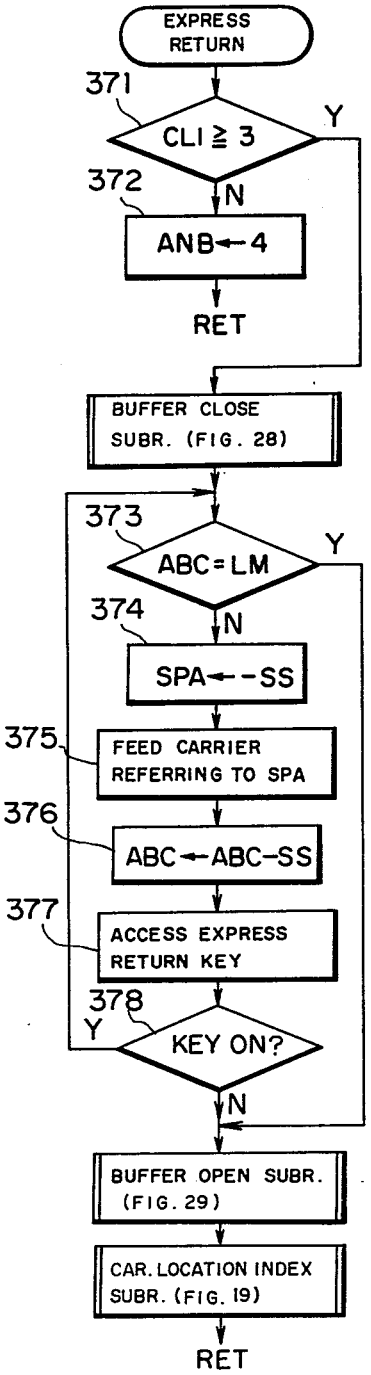

This operation is performed continuedly while the express return key 14 is held depressed. The express return subroutine is provided therefor, in which the sequence proceeds, as shown in FIG. 27, to

371 . . . The carrier located rightwardly of the left margin?

If negative and hence the carrier is currently located at or leftwardly of the beep position, the subroutine is passed through after

372 . . . Prepare for actuation of the buzzer for "error"

Thus, if the carrier is located at or leftwardly of the left margin position, depression of the express return key 14 will cause no feeding of the carrier.

On the other hand, if the judgment in step 371 is affirmative and hence the carrier is located rightwardly of the left margin position, the buffer close subroutine of FIG. 28 described hereinbefore is called whereafter the sequence goes to

373 . . . The carrier at the left margin? N

374 . . . Place the standard space count in SPA

375 . . . Feed the carrier referring to SPA

376 . . . Decrement ABC by the standard space count

377 . . . Access the express return key 14

378 . . . Express return key 14 depressed?

repeating a loop of the steps 373 to 378 while the express return key is held expressed. As the key is released in step 378 or when the left margin is reached in step 373, the express return subroutine is ended after calling in order the buffer open subroutine of FIG. 29 and the carrier location index subroutine of FIG. 19.

CARRIER RETURN MODE SELECT

As already mentioned regarding the carrier return selector 34, the presently described electronic typewriter embodying the present invention provides three different carrier return modes, i.e., a normal mode "NORM", a first automatic mode "AUTO 1" and a second automatic mode "AUTO 2" which has not yet been provided by any conventional electronic typewriter. The differences in the respective modes of operation are now explained by way of an example which is illustratively shown in (a) to (f) of FIG. 30 wherein words A, B, C and D are to typed on the record sheet.

The mode "NORM" is substantially same as, typically, of a conventional mechanical typewriter, and depression of any key other than the carrier return/line space key will cause no carrier (or carriage) return operation. Accordingly, when a long word is being typed across the right margin, either the margin release key 29 must be depressed to attain printing of the word in a single block extending beyond the right margin as illustrated by the word D at (a) of FIG. 30 or the word must be divided and printed across two different print lines with a "hyphen" suitably attached, as shown by D1 and D2 at (b) of FIG. 30. In the latter case, the carrier return key must still be depressed after printing of the hyphen.

Figure 24:
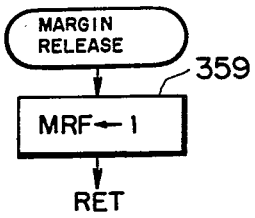

Thus, in this first approach, when the carrier 2 is at the right margin position, the margin release key 29 will be depressed. As a result, the margin release subroutine of FIG. 24 is called which includes a single step of

359 . . . Turn the margin release flag to "1".

Upon subsequent depression of a character key, the judgment in step

102 . . . The carrier at the right margin?

of the character subroutine in FIG. 9 will become affirmative so that the sequence proceeds to

103 . . . Address the carrier return mode selector 34

104 . . . Selector 34 at "AUTO 2"? N

105 . . . Margin releasable? Y and then to the sequence including the step 107 described hereinbefore which will provide printing of the character corresponding to the key depressed. Depression of another character key will provide the negative judgment in step 102 of the character subroutine, and hence the second character will be likewise printed.

Meanwhile, the latter approach is obviously nothing but printing of two separate words in two different print lines.

Secondly, in the mode "AUTO 1", which is available in some known electronic typewriters, depression of the space bar or the "hyphen" key when the carrier is located in the control zone will cause the carrier return/-line feed operation to be carried out. Thus, upon depression of the space bar after printing of the word extending across the beep position, such as the word C of (a) to (c) of FIG. 30, the carrier return operation is effected so that the subsequent next word, such as D of the same figure, may be printed at the beginning of the next new print line, as illustrated at (c) of FIG. 30.

More specifically, depression of the space bar 11 when the carrier is in the control zone with the carrier return mode selector 34 set to "AUTO 1" will cause the judgment in step 148 in the space subroutine of FIG. 10 to be turned into affirmative, followed by

149 . . . The carrier within or rightwardly of the control zone? Y and the carrier return subroutine of FIG. 23 is called to effect the carrier return operation to the beginning of a new line. Also, depression of the "hyphen" key in the similar conditions will cause, after printing of the "hyphen", the steps 129 to 132 in the character subroutine of FIG. 9 to be followed. Since the judgment in step 132 is affirmative, the carrier return subroutine is then called so that the carrier return operation is similarly carried out.

Figure 30:
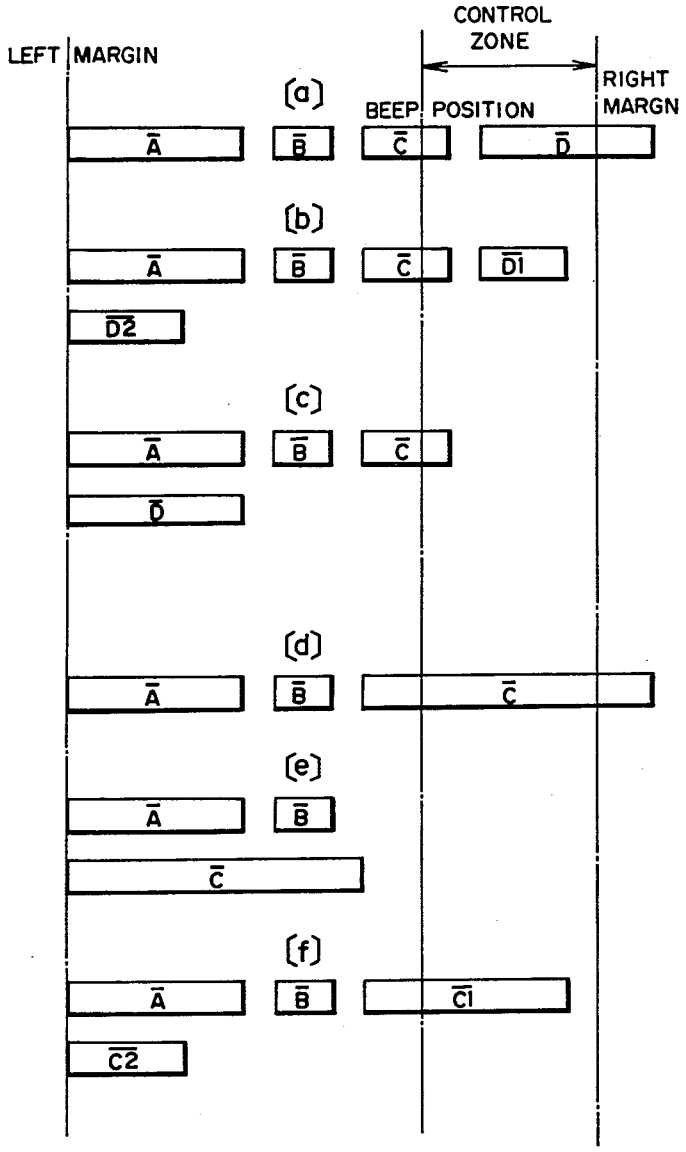
FIG. 30 is a diagrammatic illustration explanatory of a carrier return/line space operation.

In case where a word is to extend leftwardly beyond the beep position and rightwardly to or beyond the right margin from the control zone, such as the word C as illustrated at (d) of FIG. 30, the "AUTO 1" mode cannot sufficiently conveniently cope with this situation. Since such a word allows no space within the control zone, either the margin release key or the "hyphen" key must be properly depressed: in the former case, the word will be printed in a single block, such as the block C as illustrated at (d) of FIG. 30, and in the latter case, the word will be separately printed in two blocks, such as blocks C1 and C2 as shown at (f) of FIG. 30. A different approach to this problem is to print the entirety of such a word in a new print line as illustrated at (e) of FIG. 30. In this case, such a situation must be forecasted and the carrier return key must be depressed, or else, some characters of the word printed must be erased from the record sheet. In all the approaches, at least the carrier return key, the margin release key or the hyphen key must be depressed to cause the carrier return operation to be effected In the "AUTO 2" mode, printing of the format containing such a long word as shown in FIG. 30(*d*) can be attained without depression of any such key. More particularly, the "AUTO 2" mode will cause the judgment in step 104 of the character subroutine in FIG. 9 to be turned into affirmative thereby bypassing the step 105 for judging whether the margin is releasable. Thus, in the "AUTO 2" mode, the right margin is automatically released when the carrier is at the right margin (note the judgment is affirmative in step 102 of the same figure). It may be obvious that depression of the space bar or the "hyphen" key will cause the carrier return operation to be carried out by the same sequence as described above regarding the "AUTO 1" mode even when the carrier is located rightwardly of the right margin. Thus, it may be easily seen that the right margin is displaced rightwardly up to the right limit position and hence the control zone is apparently extended rightwardly to the right limit position.

EDIT OPERATION

The term "edit" as used herein means any modification of the printed text in the last two print lines on the record sheet which each contain at least one character and also any corresponding modification of information stored in the BUFF registers.

In the presently described typewriter according to the present invention, it is possible to store in the correct buffer up to two lines (i- and j-lines) of printed characters (including spaces) which have been corrected (erased) through the correct key 18 (in some case, further through the repeat key 17) as described hereinbefore in Automatic Correcting Operation and to print automatically a corrected character or characters for i- and j-lines simply by calling back the correct buffer once the print key 23 is depressed, without retyping through the character keys 10.

Generally, in order to effect any modification of the printed text on a record medium, it is necessary in the first place to depress or operate any key which may cause the print point (carrier) to move back into such printed character containing area of the record medium, such as the backspace key 12, express return key 14 or reverse paper feed key 21. Since the editing operation on the presently described typewriter embodying the present invention, however, is involved, as defined as above, in the last two print lines of the printed text on the record medium and hence whether the machine is in the edit mode or not is identified for the present or current print line, any other key which will cause forward line feeding, such as the carrier return/line space key 13 and foward paper feed key 20 may also bring the typewriter into the edit mode. On the contrary, the typewriter will identify completion of the editing operation by the print point moving to or beyond the end position of the current print line. Edit flag (EDTF) indicates whether the print point (carrier) is in the printed character containing area of the present print line or not, or in other words, whether the typewriter is in the edit mode (=1) or not (=0). In the edit mode, since there may be at the current print point a printed character of which a code is stored in the BUFF register, printing of a character is influenced by the conditions of the printed text; on the contrary, when the typewriter is not in the edit mode, printing may be freely effected as an operator desires.

Now, examples of the editing operation on the presently described typewriter embodying the present invention are explained with reference to FIG. 31. There is shown at (a) of this figure an example where a word C is to be deleted from a print line of the printed text containing words A, B, C, D and E as shown at (I), displacing the words D and E after the word B as shown at (IV).

In this case, the current typing point (carrier 2) is returned to the position next to the word C by suitably manipulating the backspace key 12 and/or express return key 14. This operation puts the typewriter into the edit mode at step 188 of FIG. 11 or at step 411 of FIG.

29 of the buffer open subroutine which is called in the express return subroutine of FIG. 27.

Then, the correct key 18 is depressed, whereupon, as discussed in Automatic Correcting Operation, the sequence of FIG. 12 is started, viz.,

207 . . . The carrier at the left limit position? N
208 . . . Automatic correction enabled? Y
210 . . . Place an end code in BUFF
211 . . . Place in SPA the standard space count with the negative sign (−)
212 . . . Feed the carrier referring to SPA
213 . . . Decrement BFP and decrement ABC by the standard space count
214 . . . BUFF contain a "character" code? Y
215 . . . Place the data of BUFF in DAZY
216 . . . Erase the character referring to DAZY
217 . . . Place a "correct" code in DAZY
218 . . . Decrement CTBF and place the data of BUFF in CTB thereby deleting the last printed character of the word C, then going to

219 . . . Edit mode?

Here, since the machine is in the edit mode, the operation continues to

220 . . . Place a "space" code in BUFF
223 . . . Key input data present?

Here, in order to delete the next preceding printed character of the word C, either the correct key 18 is depressed again or the repeat key 17 is depressed. In the former case, the sequence goes to

226 . . . Encode the key input data and store in DAZY whereas, in the latter case, the sequence goes to

224 . . . Access repeat key
225 . . . Repeat key on? Y

In either case, DAZY contains a "correct" code (in the latter case, due to step 217) at the subsequent step

227 . . . BUFF contain the first text data for i-line? N
228 . . . Data of DAZY a "correct" code Y and then returns to step 211 to thereby effect deletion of the next preceding character of the word C. Such loop of the steps will be followed until all characters forming the entire word C are deleted, erasing one character each time the loop is followed and storing a thus erased "character" code in the correct buffer in order.

After deleting the entire word C from the print line as shown at (II), the typing point (carrier) is returned to the original position it occupied before initiation of such deleting operation, namely, to the end position for the print line or the position next to the word E, by suitably operating the space bar 11 or preferably the relocate key 19. Thereupon, the edit mode is cleared either at step 170 of the space subroutine or at step 306 of the relocate subroutine. Then, the words E and D are deleted as shown as (III) by similarly operating the correct key 18 and/or the repeat key 17. It is to be noted that, while the output buffer is apparently formed into a ring register on the whole, tha correct buffer is formed on the whole as a first-in last-out type register and further that, since any other character than the correct key 18 and repeat key 17 will cause the correct subroutine to be passed through and hence depression of the correct key 18 will initiate another correcting operation in which the text data stored in the correct buffer register will be replaced by the text data corresponding to the newly deleted character, only a last incessant series of operations of the correct key 18 and/or repeat key 17 will permit future recalling of such character data deleted in the last correcting operation. Accordingly, after completion of deletion of the words D and E including a space therebetween, the correct buffer contains information of the newly deleted text data.

Figure 26A:
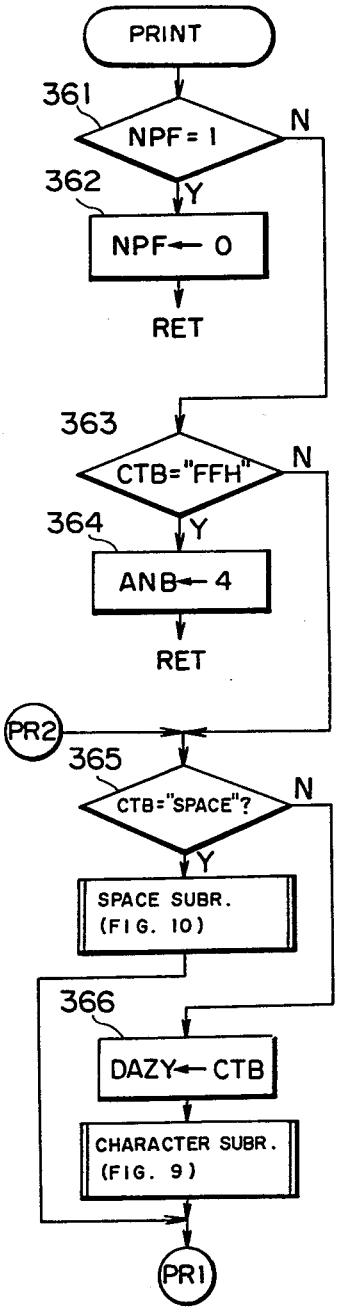
Figure 26B:
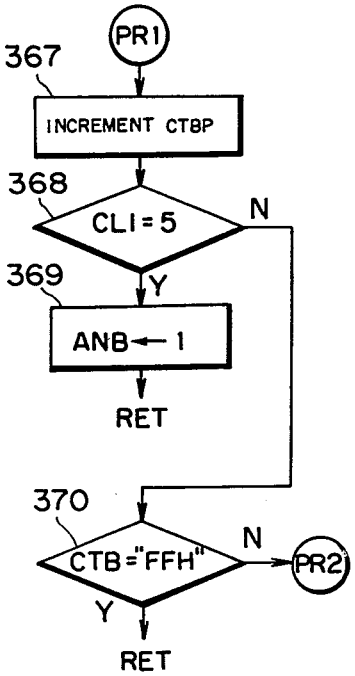

Then, the backspace key 12 or express return key 14 is suitably operated to bring the current typing point or carrier to the position corresponding to the leftmost or first character of the thus deleted character, i.e., to a position next to the space after the word B. Now, the print key 23 is depressed, whereupon the print subroutine of FIG. 26 is called to start a sequence of operations, namely

361 . . . No-print flag "1" (no-print key 22 depressed)? N
363 . . . CTB contain an end code? N
365 . . . CTB contain a "space" code?

and, if negative and hence CTB contains a "character", going to

366 . . . Place the data of CTB in DAZY and then the character subroutine of FIG. 9 is called to type the character referring to DAZY. Thus, the first character of the deleted word D is printed at the current print point on the record medium.

Then, the sequence goes to

367 . . . Increment CTBF
368 . . . Current typing point on the right margin? N
370 . . . CTB contain an end code? N and then returns to step 365 to perform printing of the second character of the word D through the same loop of the steps. This loop is followed until the entire word D is printed.

At the "space" between both words D and E, the judgment at step 365 turns into affirmative and hence the space subroutine is called to feed the carrier 2 one standard character space rightwardly. Then, the sequence goes to step 367 in the loop so that the printing of the subsequent word E is enabled. After printing of the entire word E, the judgment in step 370 turns into affirmative and thus the print subroutine is passed through. Thus, the once deleted words D and E are automatically printed after the word C as shown at (a) (IV) of FIG. 31.

In the print subroutine of FIG. 26, if the no-print flag is "1" in step 361, the subroutine is passed through after

362 . . . Clear the no-print flag.

Figure 25:
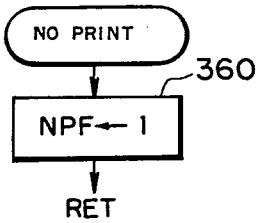

As indicated in step 360 of the no print subroutine in FIG. 25, the no-print flag is turned into "1" upon depression of the no-print key 22.

Also in the print subroutine of FIG. 26, if it is judged in step 363 that CTB contains an end code, which means that the correct buffer contains no text data to be recalled for printing, the subroutine is passed through after

364 . . . Prepare for actuation of the buzzer for "error".

Figure 31:
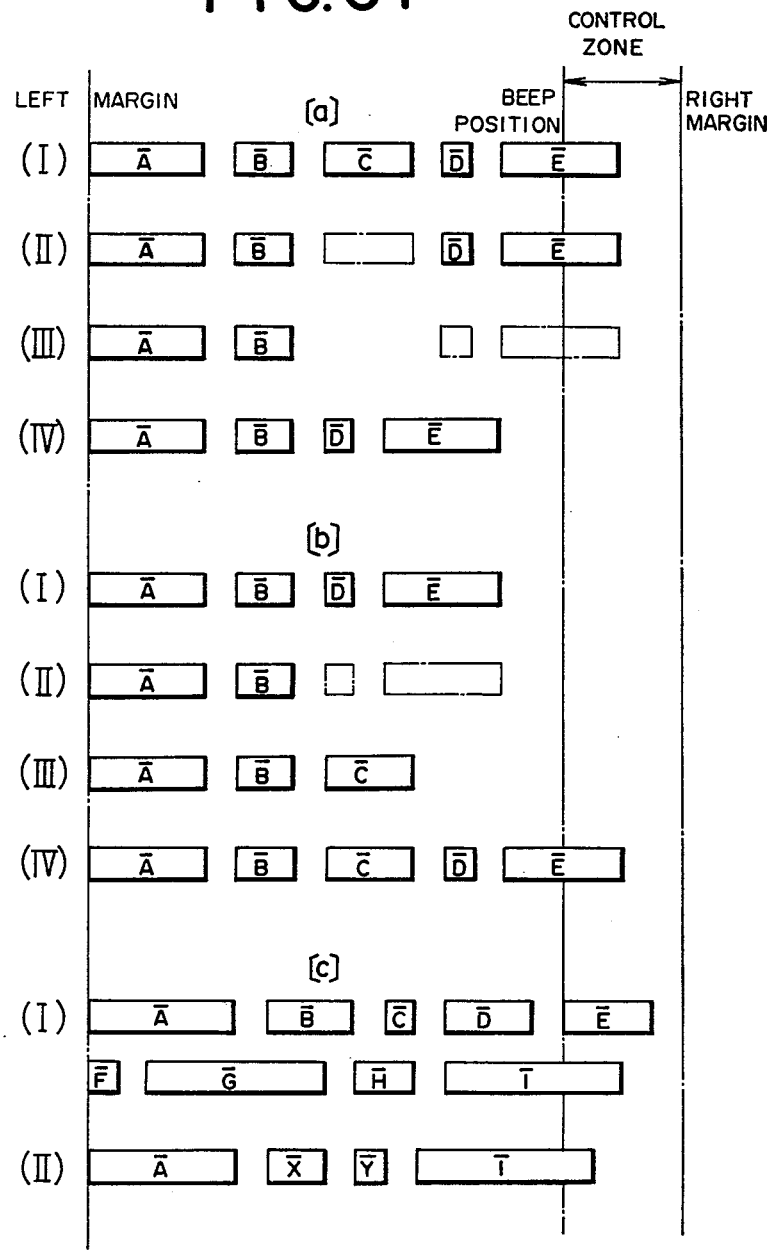
FIG. 31 is a diagrammatic illustration explanatory of an editing operation.

In contrast to the foregoing example, it may be desired in some cases that a word such as the word C of (a) (I) of FIG. 31 be replaced by another word. In such a case, the word C is first deleted in a similar manner to that described above. Here, it is to be noted that the machine is put into the edit mode when the backspace key 12 or express return key 14 is first depressed and that each of the BUFF registers which have contained character codes for the deleted word C now contains a space code after deleting of the entire word C. Such replacement of a space code for a character code is effected in step 220 following the step 227 for identifying whether the machine is in the edit mode or not. As a result, the circumstances are apparently the same as the text has been originally printed as shown in (a) (II) of FIG. 31.

Then, a key for a first character for the new word is depressed. Thereupon, the character subroutine of FIG. 9 is called, in which the sequence now goes to

100 . . . The carrier at the right limit position? N
101 . . . Edit mode? Y and to
135 . . . BUFF contain a "space"?

Here, since BUFF contains a "space" code by such replacement as described above, the sequence proceeds to

139 . . . No-print key depressed? N
140 . . . Print a character referring to DAZY Thus, the first character for the new word is printed. Then, the sequence goes to

141 . . . Enable automatic correction
142 . . . Place the data of DAZY in BUFF
143 . . . Increment BFP and then to a predetermined step of the space subroutine of FIG. 10, namely to

169 . . . BUFF contain an end code? N
171 . . . Place the standard space count in SPA
172 . . . Feed the carrier referring to SPA
173 . . . Increment ABC by the standard space count thereby feeding the carrier 2 one standard character space.

All the characters for the new word may be printed by depression of pertaining character keys. Here, if the new word is equal in length to the deleted word, then the carrier may be fed to the print line end position, for example, by operation of the relocate key 19. But, if the new word is shorter than the deleted word, the following words such as the words D and E at (a) (I) of FIG. 31 may be displaced forwardly with one standard space left between the new word and the following word such as the word D following the procedure as described in the first example. On the contrary, if the new word is longer than the deleted original word, the following words D and E may be deleted after deletion of the preceding word, then the new word may be printed by depression of character keys, and then the print key 23 may be depressed to permit the last deleted words D and E to be printed after the new word.

Sometimes, two or more words including a pertaining space therebetween may be inserted for the deleted word such as the word C as shown at (a) (I) of FIG. 31. In such a case, depression of the space bar 11 will also cause the space subroutine to be called, in which the sequence goes to

144 . . . The carrier at the right limit position? N
146 . . . Edit mode? Y
165 . . . BUFF contain a "character"? N
168 . . . Increment BFP then going to step 169 mentioned above and feeding the carrier 2 through steps 171 to 173.

In case the new word is long enough to have a character which is to be printed overlappingly on the printed character of the following word, the judgment at step 135 as mentioned above will be negative, and hence the sequence proceeds to

136 . . . BUFF contain an end code? N
138 . . . Increment BUFF and then the shift subroutine of FIG. 20 is called to enable the newly input character code to be stored in a BUFF register and printing a corresponding character in the same manner as described hereinbefore.

If it is judged in step 136 that BUFF contains an end code, which may possibly occur when a character key is depressed after the carrier has been fed to the end position for the print line by suitable operation of the space bar 11, the sequence goes to

137 . . . Clear the edit mode and then to step 118.

Shown at (b) is an example contrary to the first example (a), wherein a new word C is to be inserted between B and D as shown at (IV). In this case, after deleting the words E and D in order as shown at (II) in a similar procedure as described above, the word C is typed in by operation of character keys 10 as indicated at (III). Then, the print key 23 is depressed, whereupon the words D and E are printed automatically through the same operation as discussed in the first example.

Referring to FIG. 31(*c*), a further more complicated example is shown with intermediate steps of the procedure omitted. In order to change the text pattern (I) into the text pattern (II), after sequentially erasing the words H, G, F, E, D, C, and B in the above-described manner, the word I is erased and then the words X and Y are typed in by operation of the character keys 10 and space bar 11, followed by depression of the print key 23 for automatic printing operation of the word I.

While description has been given of deletion, insertion and accompanying displacement of a word or words, it may be obvious that any modification such as, for example, deletion or insertion of a character or characters, is also possible for the last two lines.

Appropriate use of the no-print mode or no-print key 22 could make such editing operation easier and more effective. In the no-print mode, i.e., when NPF=1, depression of a character key will bring the same effect on the typewriter as when the machine is not in the no-print mode, i.e., when NPF=0, except that the character is not actually printed on or deleted from the record medium (Refer to the steps 119, 120 and 139, 140 of the character subroutine of FIG. 9 and step 216 of the Automatic Correct Subroutine of FIG. 12).

For example, when a text is to be printed within a limited area such as, for wxample, a blank area represented by a dot and dash line in FIG. 31 (*a*) (II), the typewriter is set into the no-print mode and then the text may be entered through the keyboard whereupon the input text data is stored into a BUFF register and the carrier is fed one standard character space each time a character key or space bar is depressed in the same manner as in printing when the machine is not set in the no-print mode. If it is ascertained that the area is wide enough to accept the new text, then the text is "deleted" by operation of the correct key and/or repeat key with the machine left in the no-print mode. During this "deleting" operation, the text is deleted from BUFF registers and stored in CTB registers and the carrier is fed in the reverse or leftward direction without any actual operation of other machine elements for deleting a "printed" character. Finally, the print key is depressed twice whereupon the text is recalled from the CTB registers and is automatically printed on the record medium in a manner as described hereinbefore. It is obvious that this could also apply where a text is to be printed within a block such as of a flow chart for a computer program.

In addition, it is also possible to copy a printed text without actually deleting the printed text. In such a case, the machine is set into the no-print mode and then the text is "deleted" by operation of the correct key and/or repeat key as described above. Then, the print point is brought to a desired position, and finally the print key is depressed twice whereby the text is printed there.

We claim:

1. A typewriter having a platen, a printing mechanism for printing characters on a record sheet supported on said platen, bidirectional feeding means for feeding said printing mechanism relative to said platen, a bidirectional line indexing mechanism, a print buffer for storing therein character data being printed on the record sheet, said print buffer being capable of storing therein a predetermined number of lines of characters last printed, and an automatic correction mechanism for addressing said print buffer and for deleting printed characters from the record sheet, comprising:

a line position register responsive to operation of said line indexing mechanism for storing a count indicative of a current line position;

a plurality of line index registers each for storing a count indicative of a print line position;

control means to maintain in said index registers counts corresponding to sequential print lines which include at least one character printed independently of whether said sequential print lines contain an error;

indicator means for indicating the presence of characters printed in and hence automatically deletable from the current print line on the record sheet; and said control means being responsive to operation of said line indexing mechanism successively comparing the contents of said line index registers with the contents of said line position register and for activating said indicator means if coincidence is reached.

2. A typewriter as claimed in claim 1, wherein the printing point defined by and between said platen and said printing mechanism is backspaced within the current print line each time a printed character or a space is deleted.

3. A typewriter as claimed in claim 1 or 2, further comprising a plurality of line format registers each corresponding to one of said line index registers for storing data representative of the first and end print positions for a given print line, activation of said correction mechanism when the current print point is at the first print position for a print line resulting in indexing of said platen to the preceding print line if available and then feeding of said printing mechanism to the end print position for the thus indexed print line thereby to enable subsequent succeeding automatic deletion of printed characters for the print line by said correction mechanism.

4. A typewriter as claimed in claim 1 or 2, further comprising storage memory means for storing therein coded data representative of characters being deleted by said correction mechanism, a manually operable print enabling key; and addressing means responsive to said key for successively addressing said storage memory to recall the character data stored therein and for causing said printing mechanism to print on the record sheet a character or characters in accordance with the character data thus recalled.

5. A typewriter as claimed in claim 4, further comprising a no-print key for preventing printing operation of said printing mechanism while allowing character data to be stored in said print buffer, a first operation of said print enabling key after a preceding depression of said no-print key invalidating the effect of said no-print key whereas a second operation of said print enabling key will render said addressing means operative.

6. A typewriter as claimed in claim 4, further comprising a no-print key for preventing deleting operation of said correction mechanism while allowing said print buffer to be addressed by said correction mechanism and the coded character data to be stored in said storage memory means, a first operation of said print enabling key after a preceding depression of said no-print key invalidating the effect of said no-print key whereas a second operation of said print enabling key will render said addressing means operative.

7. A typewriter as claimed in claim 1 or 2, further comprising an error correction key manually operable to activate said automatic correction mechanism, said indicator means including a light emitting element which is associated with said correction key.

8. A typewriter as claimed in claim 1, wherein said control means maintains stored in one of said index registers a count corresponding to the line last printed on said record sheet.

* * * * *